US006619483B1

(12) United States Patent
Paine

(10) Patent No.: US 6,619,483 B1
(45) Date of Patent: Sep. 16, 2003

(54) BINDER CARRIER PACK AND CORRESPONDING BLANK

(75) Inventor: Leslie Paine, London (GB)

(73) Assignee: Traffic Works, Inc., Huntington Park, CA (US)

( * ) Notice: Subject to any disclaimer, the term of this patent is extended or adjusted under 35 U.S.C. 154(b) by 0 days.

(21) Appl. No.: 09/889,289

(22) PCT Filed: Nov. 16, 2000

(86) PCT No.: PCT/GB00/04367

§ 371 (c)(1),
(2), (4) Date: Sep. 28, 2001

(87) PCT Pub. No.: WO01/36278

PCT Pub. Date: May 25, 2001

(30) Foreign Application Priority Data

Nov. 16, 1999 (GB) ..... 9927084
Feb. 18, 2000 (GB) ..... 0003916

(51) Int. Cl.[7] ..... B65D 71/00

(52) U.S. Cl. ..... 206/784; 206/427; 206/429; 229/117.15

(58) Field of Search ..... 206/139–141, 206/152, 155, 165, 197, 326, 427, 433–435, 525–527, 479, 481, 784, 429; 229/161, 117.15

(56) References Cited

U.S. PATENT DOCUMENTS 2,351,528 A * 6/1944 Lupton ..... 229/161
2,375,631 A * 5/1945 Villard ..... 229/161
2,382,844 A * 8/1945 Arneson ..... 229/161
2,406,711 A * 8/1946 Ringler ..... 229/161
2,491,039 A * 12/1949 Fortunato ..... 229/161
2,527,478 A * 10/1950 Gray ..... 206/197
2,753,102 A * 7/1956 Paige ..... 206/197
3,747,835 A * 7/1973 Graser ..... 229/161
5,381,891 A * 1/1995 Harris ..... 206/197

FOREIGN PATENT DOCUMENTS

GB 742098 * 12/1955
GB 2013623 * 8/1979

* cited by examiner

*Primary Examiner*—Jim Foster
(74) *Attorney, Agent, or Firm*—Liniak, Berenato & White

(57) ABSTRACT

A binder (10) comprises a first panel (12) divided by a first fold line (14) from a second panel (16) which is divided by a second fold line (18) from a third panel (20), the first and second fold lines (14, 18) being intersected by three slits (22, 24, 26), the central slit (22) being longer than the first and second outer slits (24, 26), and each end of the central slit (22) being joined to an adjacent end of each of the first and second outer slits (24, 26) by a respective crease line (28*a*, 30*a*, 28*b*, 30*b*); whereby, when the third panel (20) is folded about outer parts of the first and second fold lines (14, 18) to be spaced from yet overlie the first panel (12), the material between the central slit (22) and the first outer slit (24) is folded about its associated crease lines and the inner parts of the first and second fold lines to form a first strap (32), and the material between the central slit (22) and the second outer slit (26) is folded about its associated crease lines and the inner parts of the first and second fold lines to form a second strap (34).

13 Claims, 40 Drawing Sheets

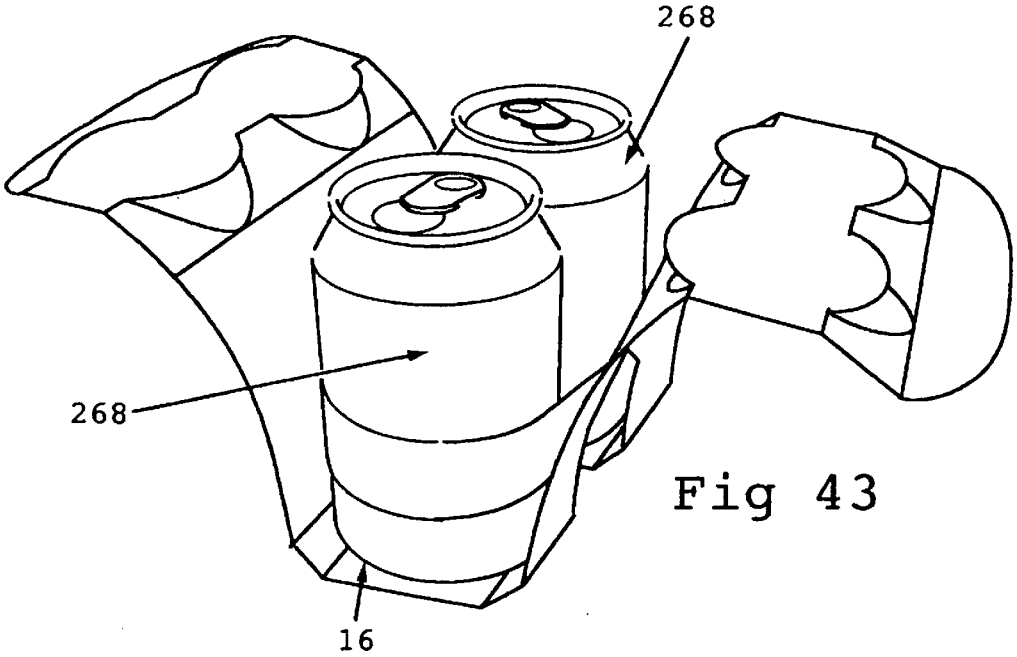
Fig 43
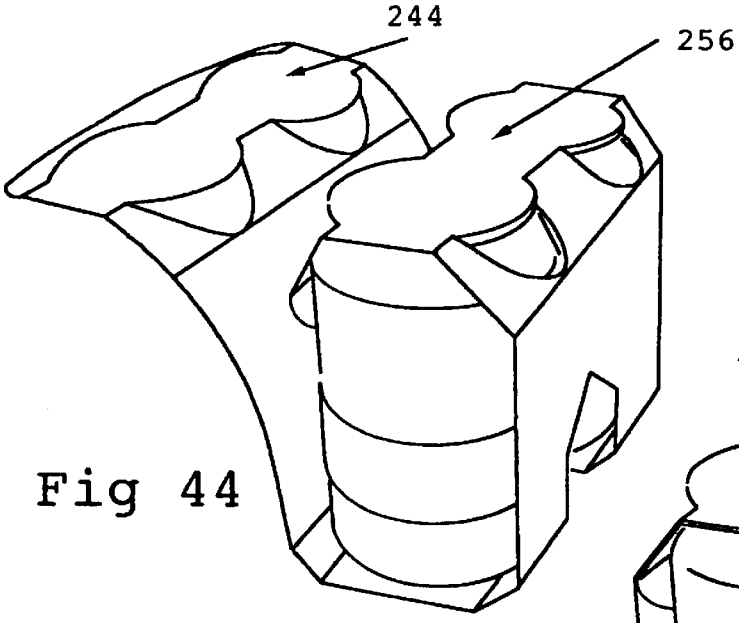
Fig 44
Fig 45
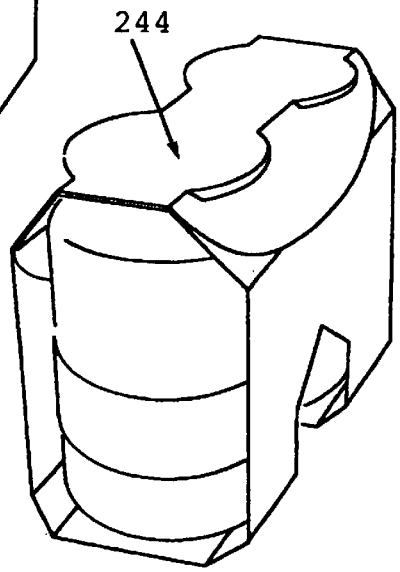

BINDER CARRIER PACK AND CORRESPONDING BLANK

The present invention relates to binders which are especially but not exclusively suitable for use in the storage of monthly journals or other periodicals.

Typically, periodicals are stored in binders which are of a sleeve-like appearance as a result of being open at one end, and partially open at one side. The binders may be designed to hold, for example, six or twelve periodicals standing side-by-side. However, the binders are clearly not restricted to use in the storage of periodicals, and are instead often used in the storage of other generally flat items, such as long playing records or loose printed sheets of music.

Typically, the binders are made of cardboard, or moulded of plastics materials, and in any event are supplied in an assembled condition which is ready-to-use.

This takes up considerable space during transit.

An object of the present invention, therefore, is to provide binders which can be shipped by a manufacturer, posted by a distributor or sold by a retailer in a generally planar form for subsequent assembly by an end user.

According to the present invention, a binder comprises:

a first panel divided by a first fold line from a second panel which is divided by a second fold line from a third panel, the first and second fold lines being intersected by three slits, the central slit being longer than the first and second outer slits and each end of the central slit being joined to an adjacent end of each of the first and second outer slits by a respective crease line;

whereby, when the third panel is folded about outer parts of the first and second fold lines to be spaced from yet overlie the first panel, the material between the central slit and the first outer slit is folded about its associated crease lines and the inner parts of the first and second fold lines to form a first strap, and the material between the central slit and the second outer slit is folded about its associated crease lines and the inner parts of the first and second fold lines to form a second strap.

It will be appreciated that the binder can be readily assembled by the end user merely by following simple instructions.

It will also be appreciated that, after assembly, the first and third panels can be regarded as the front and rear of the binder, the outer parts of the second panel can be regarded as the base of the binder, and the inner parts of the second panel constituting the central parts of the first and second straps can be regarded as the sides of the binder.

Before discussing various modifications, such as extending the first panel to allow the binder to be closed at the top or extending/reducing the second panel to allow the binder to be of greater/smaller storage capacity, it will be convenient to discuss preferred materials as well as preferred methods of forming the slits, fold lines and crease lines in the preferred materials.

The binder is preferably formed in one piece of sheet or sheet-like material which is flexible yet durable.

The material is preferably a plastics material such as one of the olefins, e.g. polypropylene or polyethylene, or alternatively acetate or polyvinyl chloride. However, the material could be of any suitable composition, such as paper, cardboard, metal or fabric, or a laminate in which, for example, a plastics material is covered by a metallic foil. Moreover, the material is preferably translucent but could alternatively be either clear or opaque.

The material is preferably extruded or rolled to be initially of substantially uniform thickness throughout. Then, conventional die cutting technology may enable the slits to be produced by cutting rules, and may enable the fold lines and the crease lines to be produced by creasing rules. In practice, the cutting rules are considerably sharper than the creasing rules. Alternatively, a separate operation to form the slits, fold lines and crease lines may be avoided if the material is moulded to be of non-uniform thickness using conventional casting, pressing or injection moulding techniques.

Preferably, the binder is supplied to the end user in a condition which is ready-to-be-assembled i.e. with the slits, fold lines and crease lines having all been fully pre-formed.

Nevertheless, there may be circumstances in which it is desirable for the binder to be supplied to the end user in a condition which is not ready-to-be-assembled i.e. with the slits, fold lines and crease lines not having all been fully pre-formed.

For example, to help maintain structural integrity during transit to the end user, one or more of the slits may have been just partly pre-formed as a result of being spanned by one or more webs or other frangible connections which need to be broken by the end user.

Additionally, or alternatively, to help prevent crumpling during transit to the end user, one or more of the fold lines and the crease lines may have been insufficiently pre-formed or, as an extreme, may merely have had their intended locations indicated to the end user, for example by one or more printed lines or other guide marks.

The difference between the slits, the fold lines and the crease lines may need to be explained to the end user—it is possible, for example, that the slits are formed from perforated lines with relatively small webs which are readily broken, whereas the fold lines and the crease lines are formed from perforated lines with relatively large webs which are not readily broken.

There may well be little if any practical difference between the constructions of the fold lines and the crease lines—in each case, there is a line of intended deformation which may be either present in the material before the binder is assembled by the end user, or present in the material only after the binder is assembled by the end user.

As previously indicated, various modifications are possible.

In one modification, which is useful when there is a risk of the binder's contents falling out, the first panel is extended to form a flap to be folded over and secured to the third panel, thereby allowing the binder to be closed at the top.

Another modification allows the binder to maintain its assembled condition and not collapse, even when the binder has not been completely filled, the assembled condition being maintained by securing each of the first and second straps to the first and third panels.

In general, parts of the binder which are to be secured to one another are preferably secured to one another by adhesive or tab/slot connections or other fixings which come with the binder so that additional fixings are not required by the end user.

If the binder is to be used with particularly thin contents, the first and second fold lines are preferably coincident with one another, or are at least extremely close to one another, across the entire width of the binder so that the second panel effectively disappears.

However, if the binder is to be used with contents which in combination are generally triangular in side elevation, the first and second fold lines are preferably coincident with one another, or are at least extremely close to one another, only at their outer parts so that the outer parts of the second panel effectively disappear, or alternatively only at their inner parts so that the inner parts of the second panel effectively disappear.

In other modifications, the binder is provided with a handle or an inner sleeve either or each of which can be separate from the binder but is preferably an integral part of the binder.

There is no need for the binder to be symmetrical and thus, rather than being parallel or substantially parallel to the central slit, the first and second outer slits can be curved or angular.

It should be appreciated that the assembled binder is not restricted to being of rectangular outline, when viewed in any orthogonal direction, but could at least reflect the outline of the intended contents.

Moreover, it should be appreciated that the assembled binder is not restricted to storing contents which are arranged in a single stack, but could store contents arranged in two or more stacks merely by duplicating the above-defined construction of the slits, fold lines and crease lines.

If there is such duplication, it would be possible for contents of the correct width to extend between a first strap associated with a first set of three slits and a second strap associated with a second set of three slits. The second strap associated with the first set of three slits, and the first strap associated with the second set of three slits, would thus be redundant and if desired could be omitted. The resulting construction would be such that, in effect, a single central slit had been split into two separate central slits.

Splitting the central slit into two is within the present invention just as joining the or parts of the first and second fold lines into one is within the present invention.

In a particularly preferred modification, the storage capacity of the binder can be adjusted in a series of set increments. To this end, a series of the first and/or second fold lines is provided to allow the distance between the first and the third panels to be adjusted. At the same time, to allow the central parts of the first and second straps to continue to act as the sides of the assembled binder, all of the three slits are capable of being lengthened. The lengthening is readily achieved by pre-forming each of the three slits with a plurality of slit extensions which are brought into operation by selective breaking of frangible connecting webs.

In general, the lengths of the slits can be adjusted so that the final positions of the central parts of the straps can fall inside or outside the side edges of the first and third panels.

The various modifications are not necessarily independent of one another but could be combined with one another.

Consequently, if the modification providing the top flap is combined with the modification providing the adjustable storage capacity, it is preferred that the top flap be formed with a pair of catches, each of which could be a double catch, for allowing the top flap to be releasably secured to selected slits in two series of slits formed in the third panel.

In yet another modification, the first and second outer slits can be regarded as having migrated outwards to be coincident with the side edges of the binder, structural integrity being achieved by either inserting an integral inner sleeve into the open sleeve formed from the first, second and third panels or, alternatively, wrapping an integral outer sleeve around the open sleeve formed from the first, second and third panels.

There are a number of advantages which are common to all of the binders according to the present invention and which are in addition to those previously indicated.

For example, the use of rectangular blanks with slits and creases gives rise to very little wasted material, the use of material with major faces of different colour (e.g. co-extrusion) gives rise to colour contrast in the assembled binder because of the way in which the straps are folded, and the use of a simple principle of construction allows many different types of contents to be packaged such as wall tiles, CD jewel cases, or credit cards and not just periodicals, photographs or loose sheets of paper.

Several binders, in accordance with the present invention, will now be described in greater detail, by way of example only, with reference to the accompanying drawings, in which:

FIGS. 43, 44 and 45 are perspective views showing sequential stages in the assembly of the binder from the blank of FIG. 41 with beverage cans;

As previously discussed, binders of the present invention are preferably formed of plastics materials (although materials other than plastics materials would be possible) in which structural elements such as slits, fold lines and crease lines are preferably formed by conventional die cutting technology (although again other methods of forming such structural elements would be possible).

Thus, each of the binders illustrated in the accompanying drawings could be formed from a sheet of polypropylene of, for example, 0.5 mm thickness, with all of the slits having been fully pre-formed by cutting rules and with all of the fold lines and the crease lines having been fully pre-formed by creasing rules, whereby each of the binders is capable of being supplied to an end user in a ready-to-be-assembled condition.

The dimensions and indeed the proportions will clearly depend upon the particular circumstances i.e. the particular articles to be stored in the binders.

Figure 1:
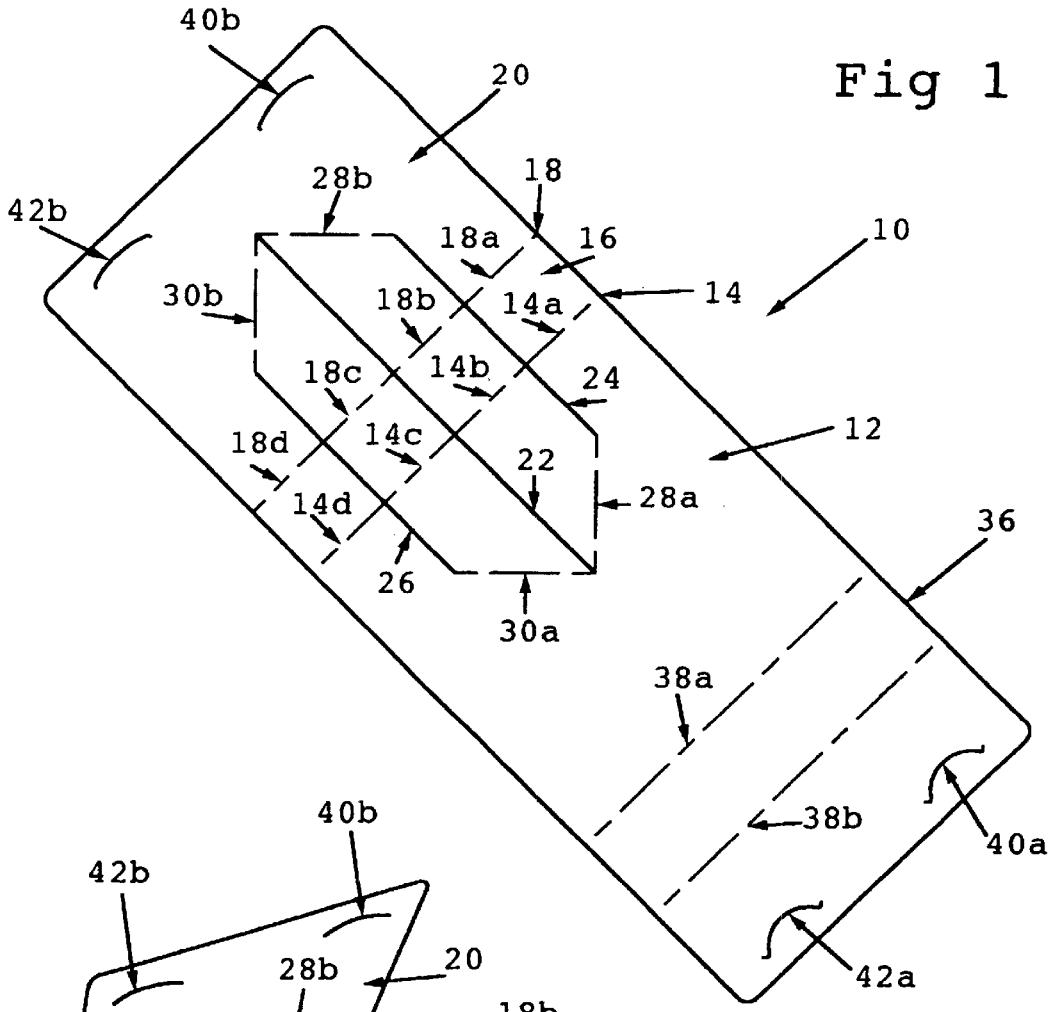
FIG. 1 is a plan view of a blank for a binder.

FIG. 1 shows a blank for a binder 10, according to the present invention, which is particularly suitable for storing a stack of five so-called floppy disks (not shown).

The binder 10 comprises a first panel 12 divided by a first fold line 14 from a second panel 16 which is divided by a second fold line 18 from a third panel 20. It will be seen that the first fold line 14 is parallel or substantially parallel to the second fold line 18. It will also be seen that the first fold line 14 and the second fold line 18 are intersected by a slit 22 which is located centrally between a pair of outer slits 24 and 26.

The central slit 22 is longer than the first outer slit 24 and the second outer slit 26.

The first fold line 14 includes, in order, an outer part 14*a*, an inner part 14*b* between the first outer slit 24 and the central slit 22, another inner part 14*c* between the central slit 22 and the second outer slit 26, and another outer part 14*d*.

Similarly, the second fold line 18 includes, in order, an outer part 18*a*, an inner part 18*b* between the first outer slit 24 and the central slit 22, another inner part 18*c* between the central slit 22 and the second outer slit 26, and another outer part 18*d*.

One end of the central slit 22 is joined to an adjacent end of the first outer slit 24 by a crease line 28*a* and is joined to an adjacent end of the second outer slit 26 by a crease line 30*a*. The other end of the central slit 22 is joined to an adjacent end of the first outer slit 24 by a crease line 28*b* and is joined to an adjacent end of the second outer slit 26 by a crease line 30*b*.

Figure 2:
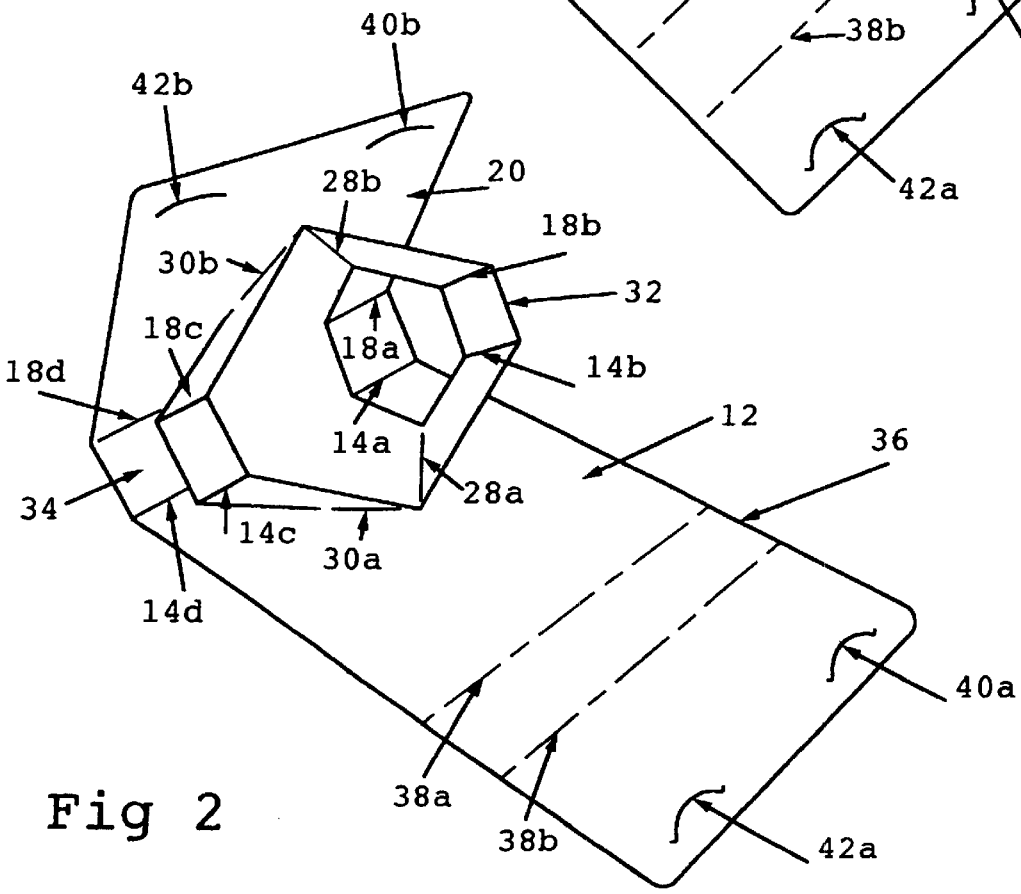
FIGS. 2 to 4 are perspective views showing sequential stages in the assembly of the binder from the blank of FIG. 1.
Figure 3:
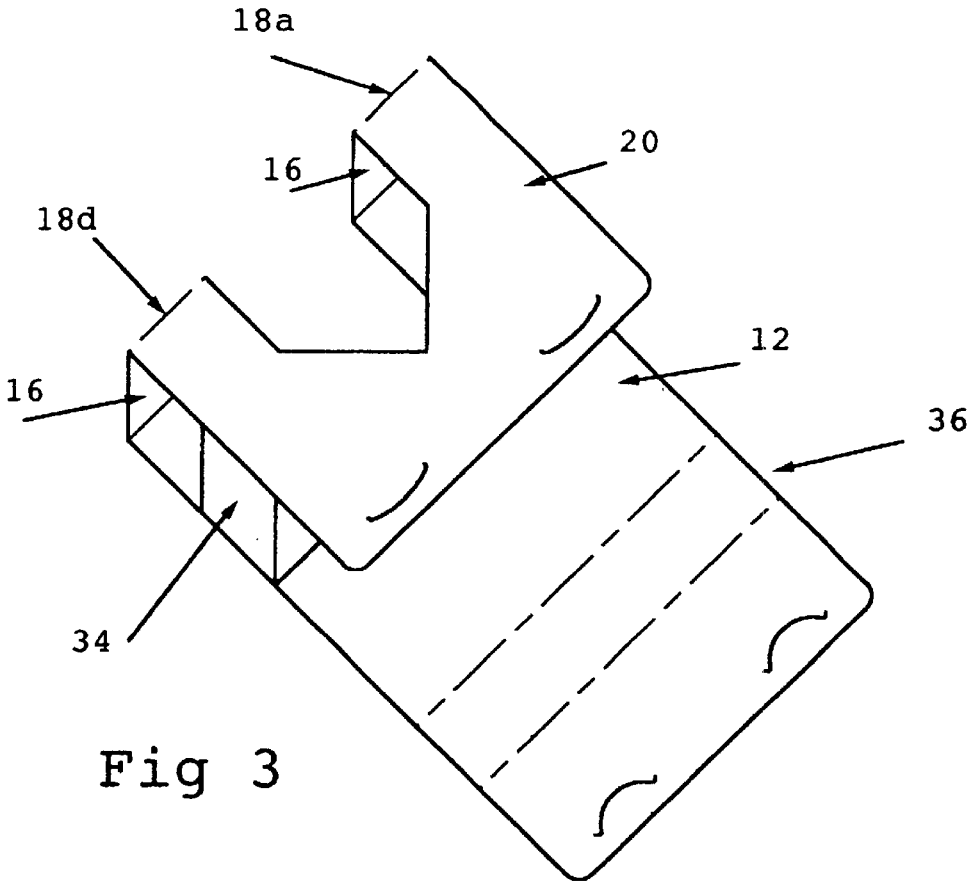
Figure 4:
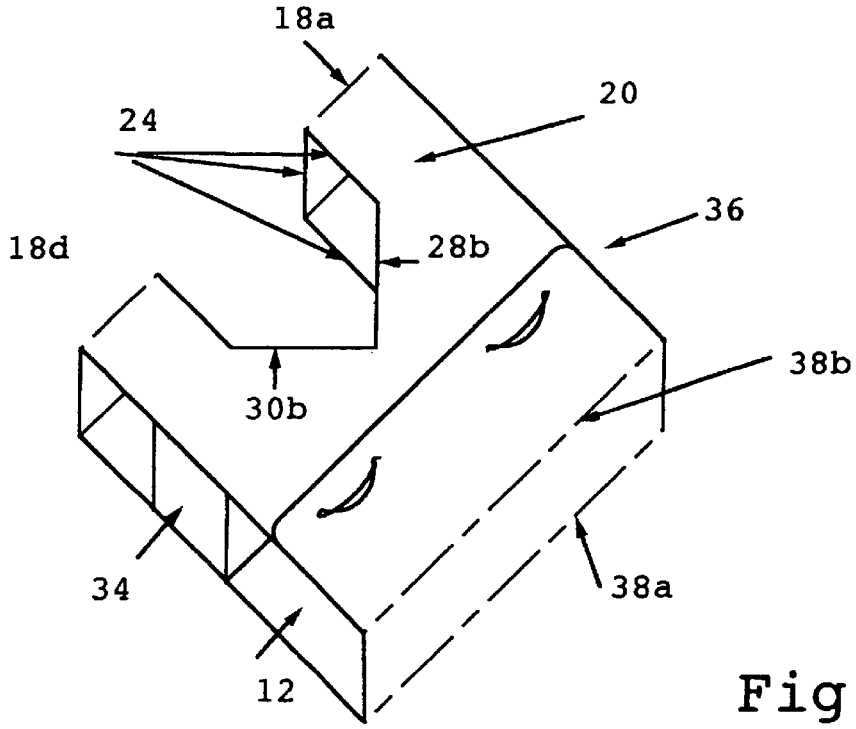

FIGS. 2 to 4 show sequential stages in the assembly of the binder 10 from the blank of FIG. 1.

Initially, as shown in FIG. 2, the third panel 20 is folded about the outer parts 14*a*, 14*d* and 18*a*, 18*d* of the first and second fold lines 14, 18 to be spaced from yet overlie the first panel 12. The material between the central slit 22 and the first outer slit 24 is folded about its associated crease lines 28*a*, 28*b* and the inner parts 14*b*, 18*b* of the first and second fold lines 14, 18 to form a first strap 32. The material between the central slit 22 and the second outer slit 26 is folded about its associated crease lines 30*a*, 30*b* and the inner parts 14*c*, 18*c* of the first and second fold lines 14, 18 to form a second strap 34.

All of the above-described folding operations preferably occur simultaneously.

With continued folding, the position of FIG. 3 is reached in which the second panel 16 lies perpendicularly to both the first panel 12 and the third panel 20. The first panel 12 abuts the first strap 32 between the crease line 28*a* and the inner part 14*b* of the first fold line 14 and abuts the second strap 34 between the crease line 30*a* and the inner part 14*c* of the first fold line 14. At the same time, the third panel 20 abuts the first strap 32 between the crease line 28*b* and the inner part 18*b* of the second fold line 18 and abuts the second strap 34 between the crease line 30*b* and the inner part 18*c* of the second fold line 18.

The central part of the first strap 32 is constituted by an inner part of the second panel 16 bounded by some of the central slit 22, the inner part 14*b* of the first fold line 14, some of the first outer slit 24, and the inner part 18*b* of the second fold line 18.

The central part of the second strap 34 is constituted by another inner part of the second panel 16 here bounded by some of the central slit 22, the inner part 14*c* of the first fold line 14, some of the second outer slit 26, and the inner part 18*c* of the second fold line 18.

It will thus be appreciated that the first and third panels 12, 20 can be regarded as the front and rear of the binder 10, the outer parts of the second panel 16 can be regarded as the base of the binder 10, and the inner parts of the second panel 16 can be regarded as the sides of the binder 10.

To close the top of the binder 10, as shown in FIG. 4, the first panel 12 is shown as having been.extended to form a flap 36. A pair of fold lines 38*a*, 38*b* in the flap 36 are separated by a distance corresponding to the separation between the first and second fold lines 14, 18. A pair of curved slits 40*a*, 42*a* in the flap 36 are releasably joinable to a complementary pair of curved slits 40*b*, 42*b* in the third panel 20. Such slit/slit connections are well known per se and need not be discussed in any more detail.

Figure 5:
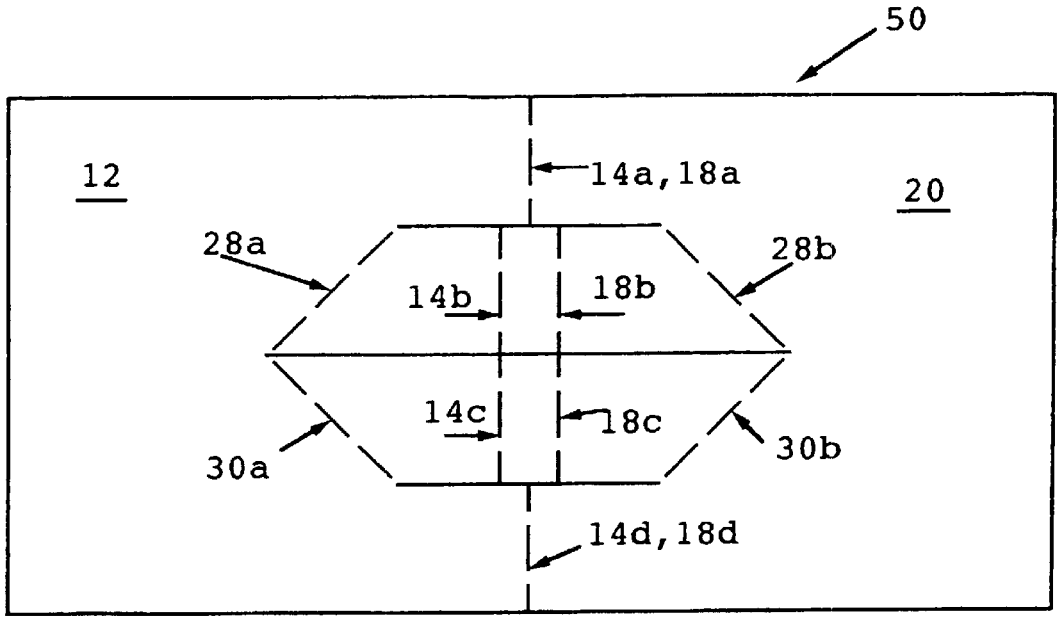
FIG. 5 is a plan view of a blank for forming a binder in which the outer parts of the first and second fold lines are coincident.

FIG. 5 shows a blank for a binder 50 in which the outer parts 14*a*, 14*d* of the first fold line 14 are respectively coincident with the outer parts 18*a*, 18*d* of the second fold line 18. When the binder 50 is assembled, by following the above-described folding operations, it is found that the first and second straps 32, 34 are the same as those for the binder 10. However, the outer parts of the second panel 16 effectively disappear so that the base is of minimal thickness. This is particularly convenient for the storage of articles which, in combination, are generally triangular in side elevation with a base of reduced thickness.

Figure 6:
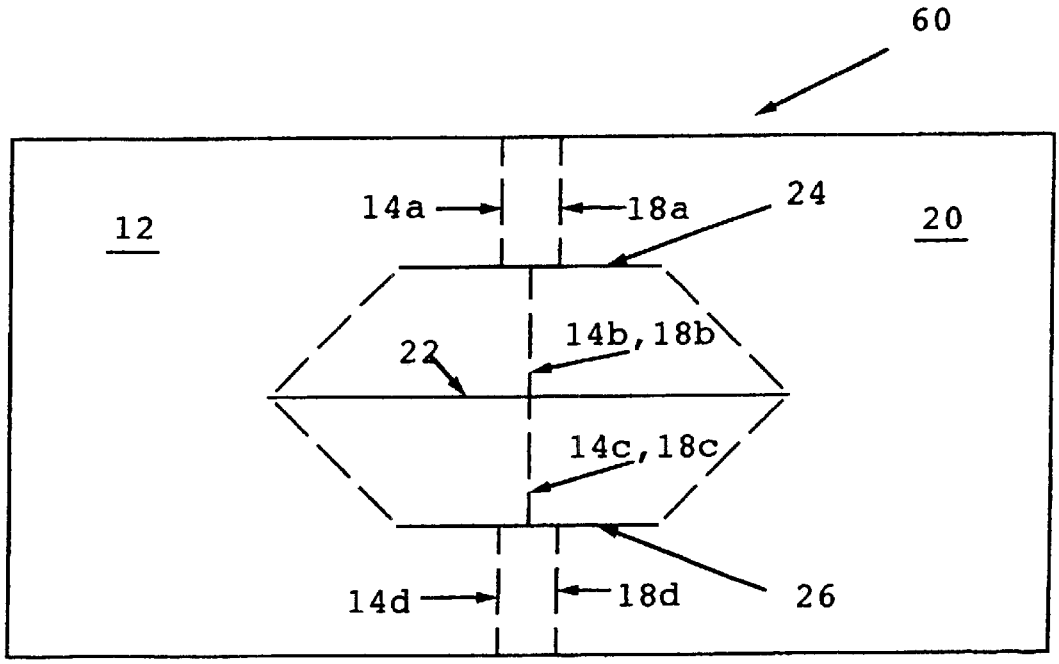
FIG. 6 is a plan view of a blank for forming a binder in which the inner parts of the first and second fold lines are coincident.

FIG. 6 shows a blank for a binder 60 in which the inner parts 14*b*, 14*c* of the first fold line 14 are respectively coincident with the inner parts 18*b*, 18*c* of the second fold line 18. When the binder 60 is assembled, by following the above-described folding operations, it is found that the central parts of the first and second straps 32, 34 effectively disappear. In other words, the inner parts of the second panel 16 are of minimal thickness whereas the outer parts of the second panel 16 are the same as those for the binder 10. This is again particularly convenient for the storage of articles which, in combination, are generally triangular in side elevation but here of reducing thickness with increasing distance from the base.

Figure 7:
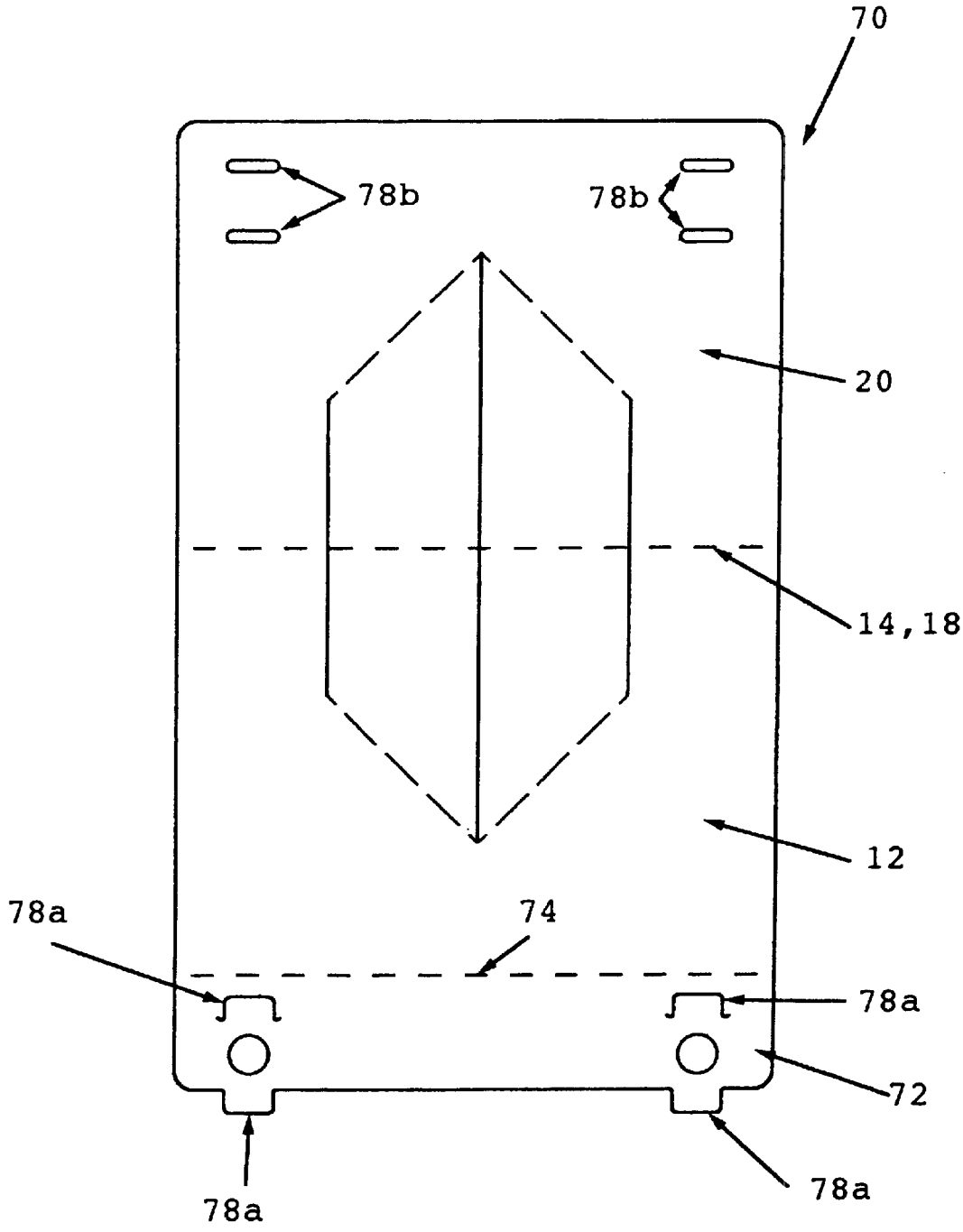
FIG. 7 is a plan view of a blank for forming a binder in which the first and second fold lines are coincident across their entire widths.

FIG. 7 shows a blank for a binder 70 in which the first and second fold lines 14, 18 are coincident with one another along their entire lengths so that all of the second panel effectively disappears.

Figure 8:
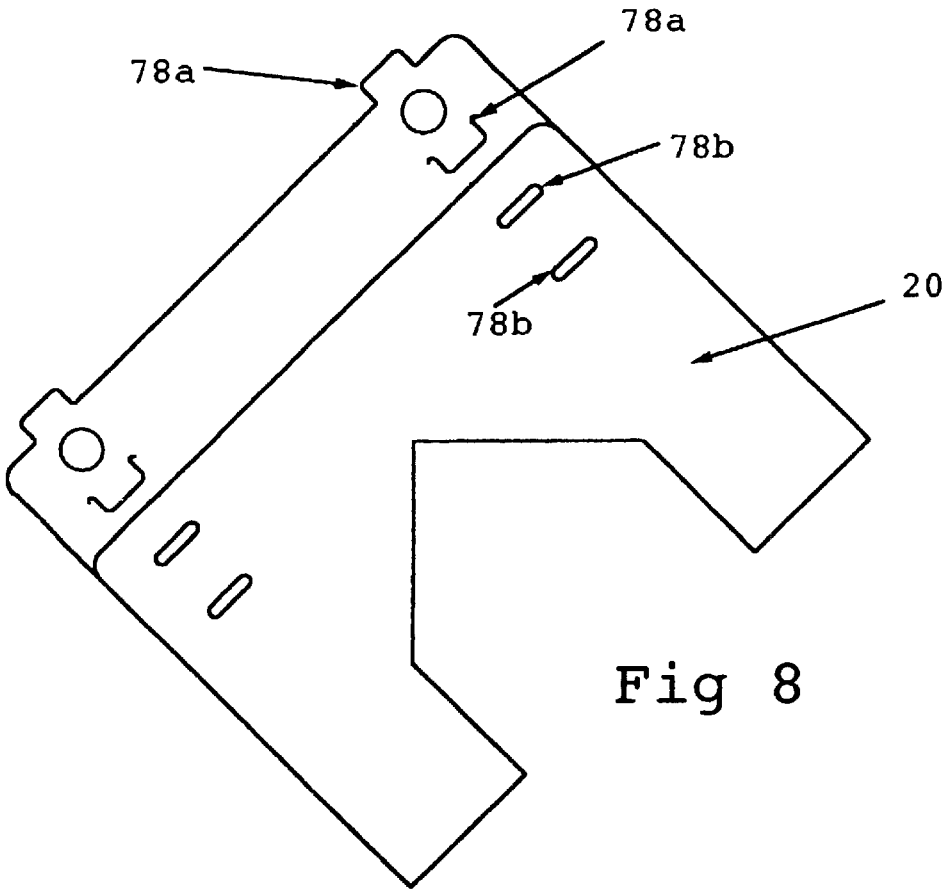
FIGS. 8 and 9 are perspective views showing sequential stages in the assembly of the binder from the blank of FIG. 7.
Figure 9:
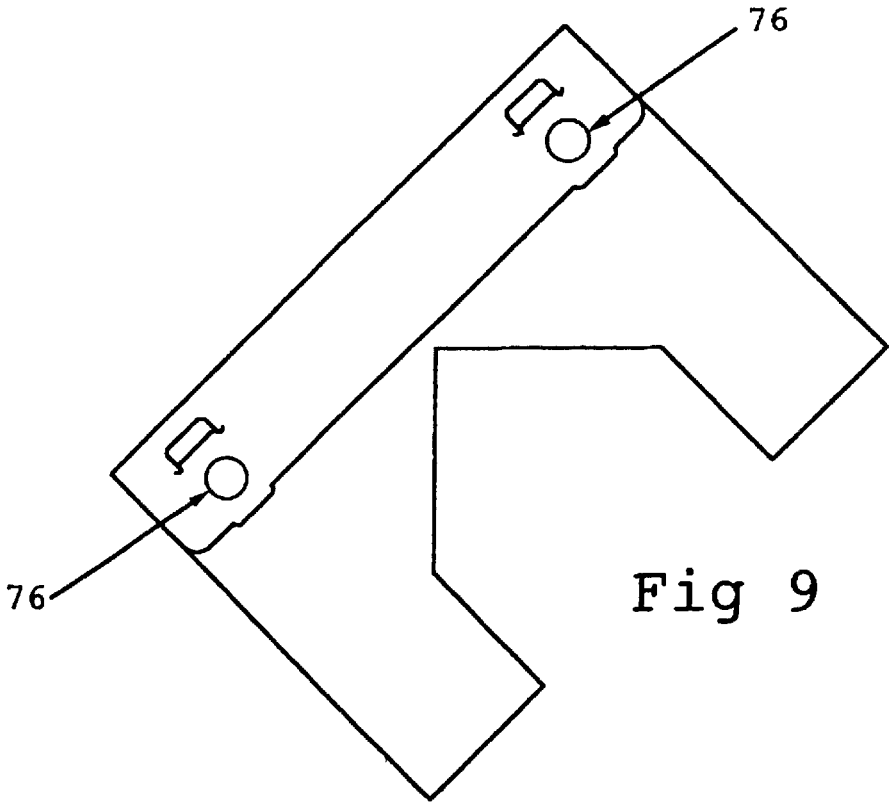

It will be appreciated, from the discussion of FIGS. 5 and 6, that the base and the sides of the binder 70 are all of minimal thickness for use in storing thin articles, such as merely a few photographs. To prevent the thin articles from falling out, the first panel 12 is divided from a flap 72 by a single fold line 74 so that, as shown in FIGS. 8 and 9, the flap 72 can be brought into abutment with the third panel 20. As an alternative to the slit/slit connections of the binder 10, the binder 70 is formed with a pair of tab/slot double catches 76. Each of the double catches 76 includes a pair of tabs 78*a* which are presented by the flap 72 and are releasably connectable to respective ones of a pair of slots 78*b* formed in the third panel 20.

Figure 10:
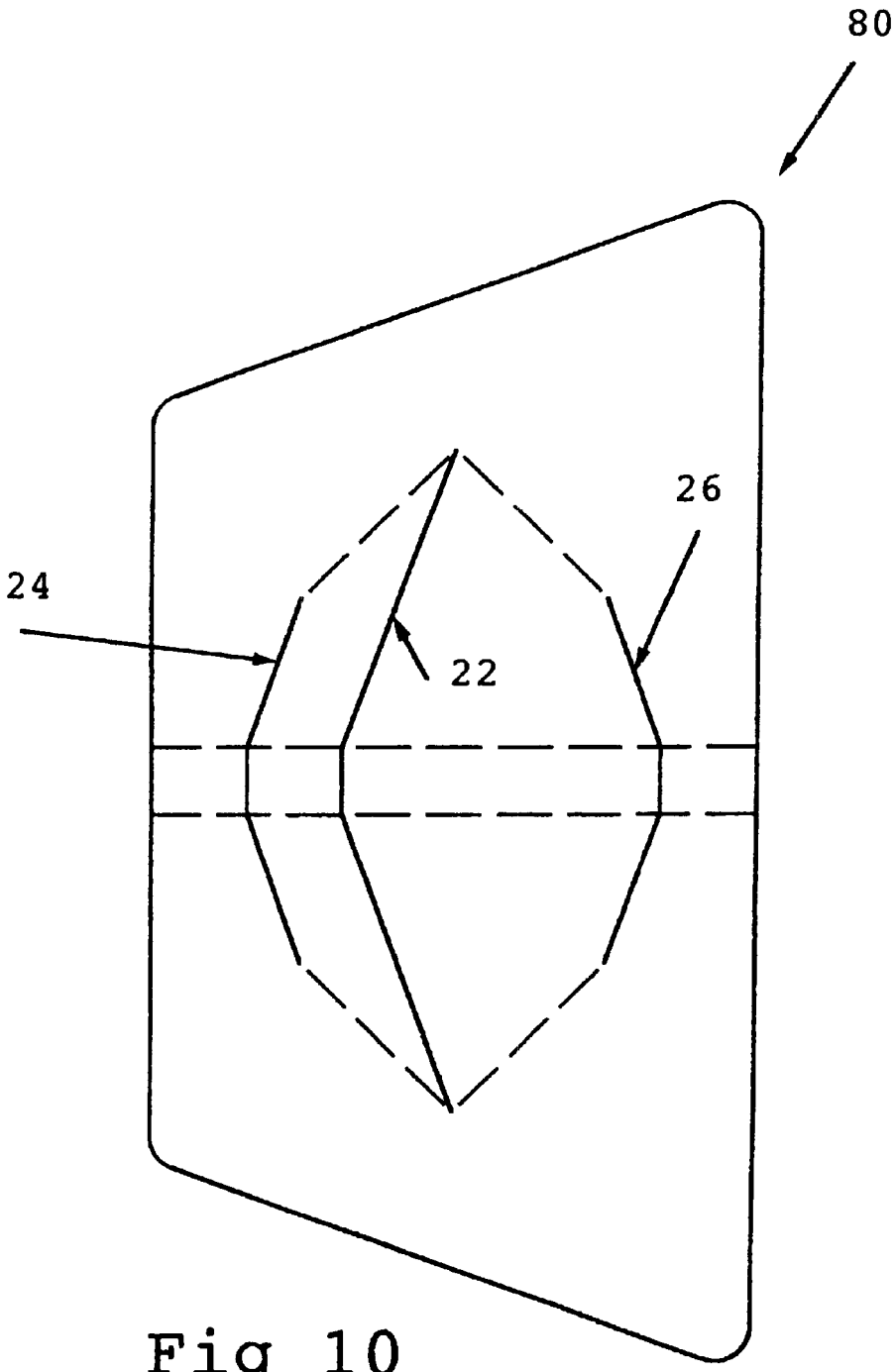
FIG. 10 is plan view of a blank for forming a binder in which none of the slits is straight.

FIG. 10 shows a blank for a non-rectangular binder 80 in which the central slit 22, the first outer slit 24 and the second outer slit 26 are all angular rather than straight.

Figure 11:
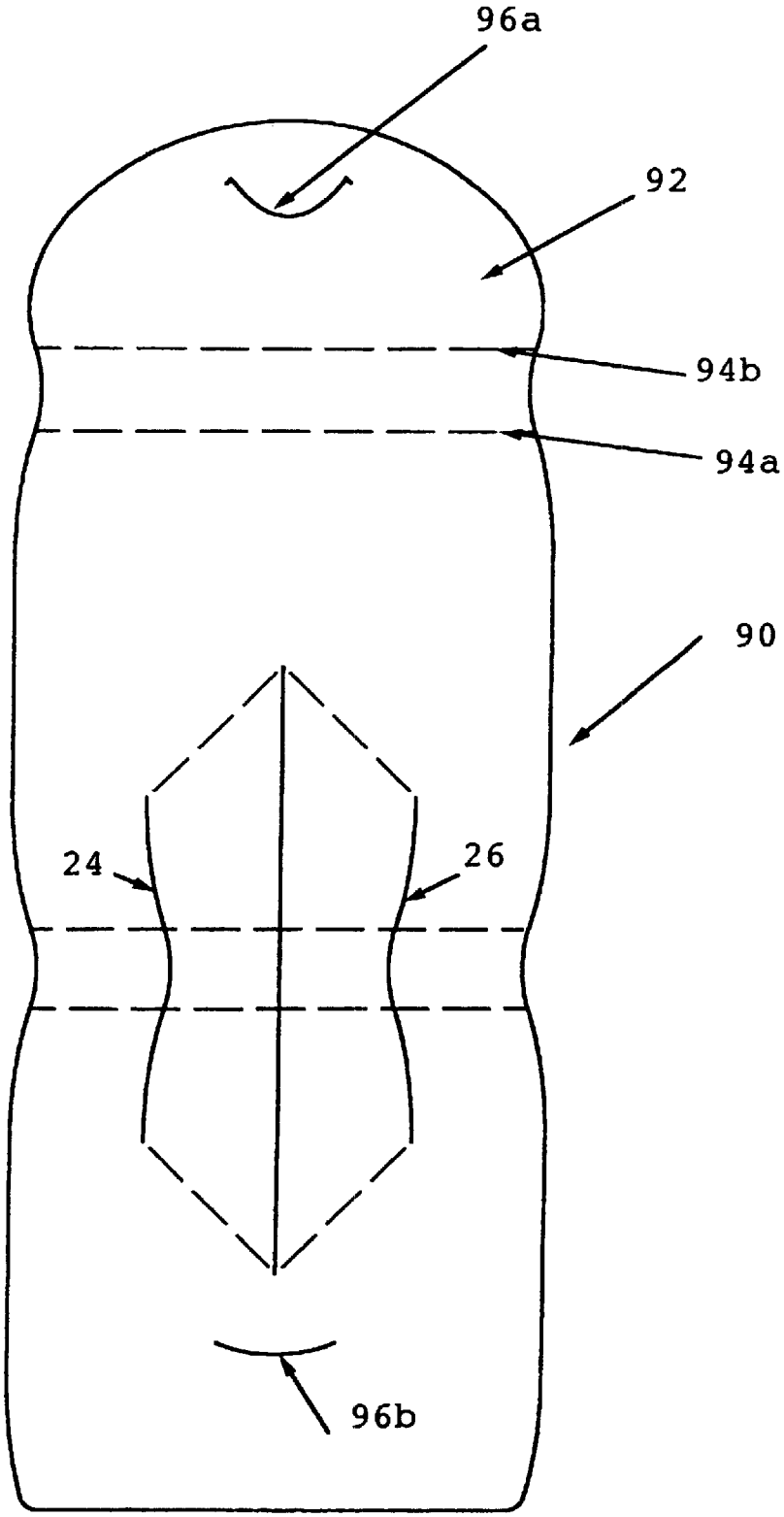
FIG. 11 is a plan view of a blank for forming a binder in which the first and second outer slits are curved.

FIG. 11 shows a blank for a non-rectangular binder 90 in which the first and second outer slits 24, 26 are curved and a curved flap 92 is provided with a pair of fold lines 94*a*, 94*b* but there is only a single central slit/slit connection 96*a*, 96*b*.

Figure 12:
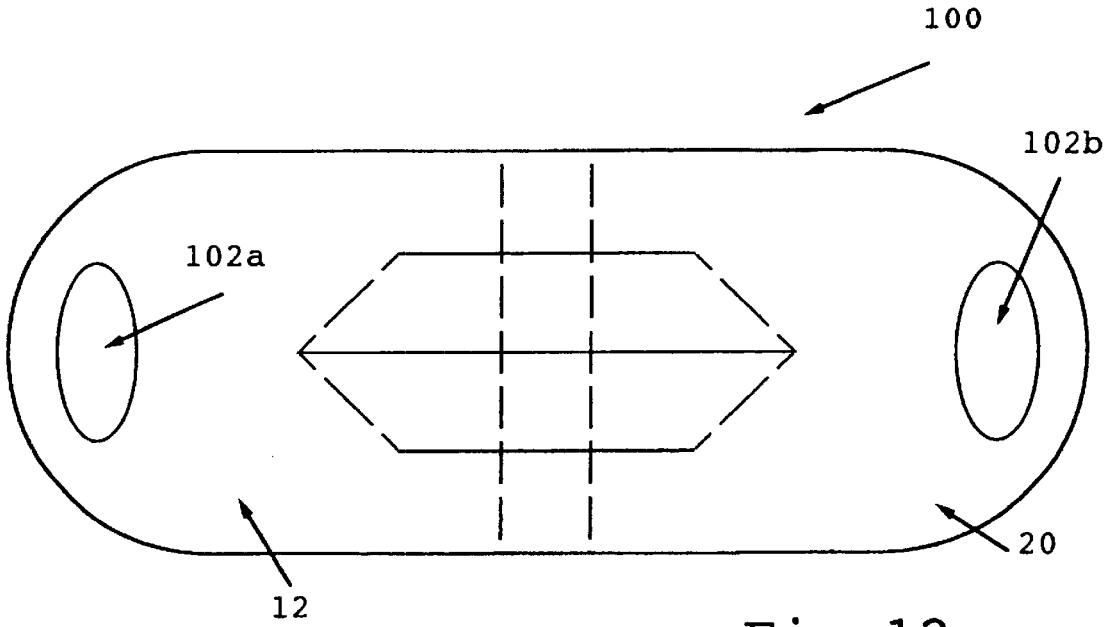
FIG. 12 is a plan view of a blank for forming a binder incorporating a handle.
Figure 13:
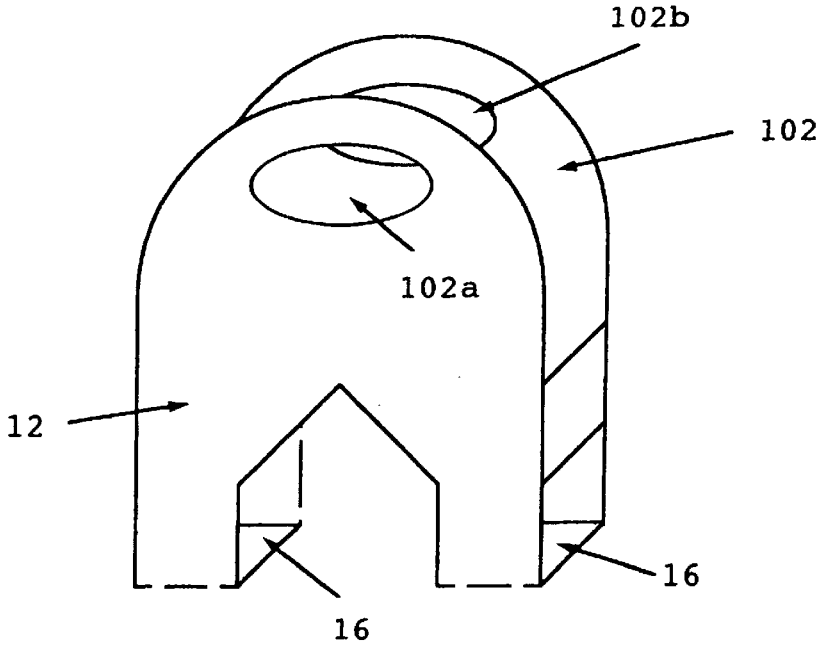
FIG. 13 is a perspective view of the binder assembled from the blank of FIG. 12.

FIGS. 12 and 13 show a binder 100 respectively before and after its assembly from a blank in which each of the first and third panels 12, 20 is formed with an oval aperture 102*a*, 102*b* which together can be regarded as a handle 102 formed integrally with the binder 100.

Figure 14:
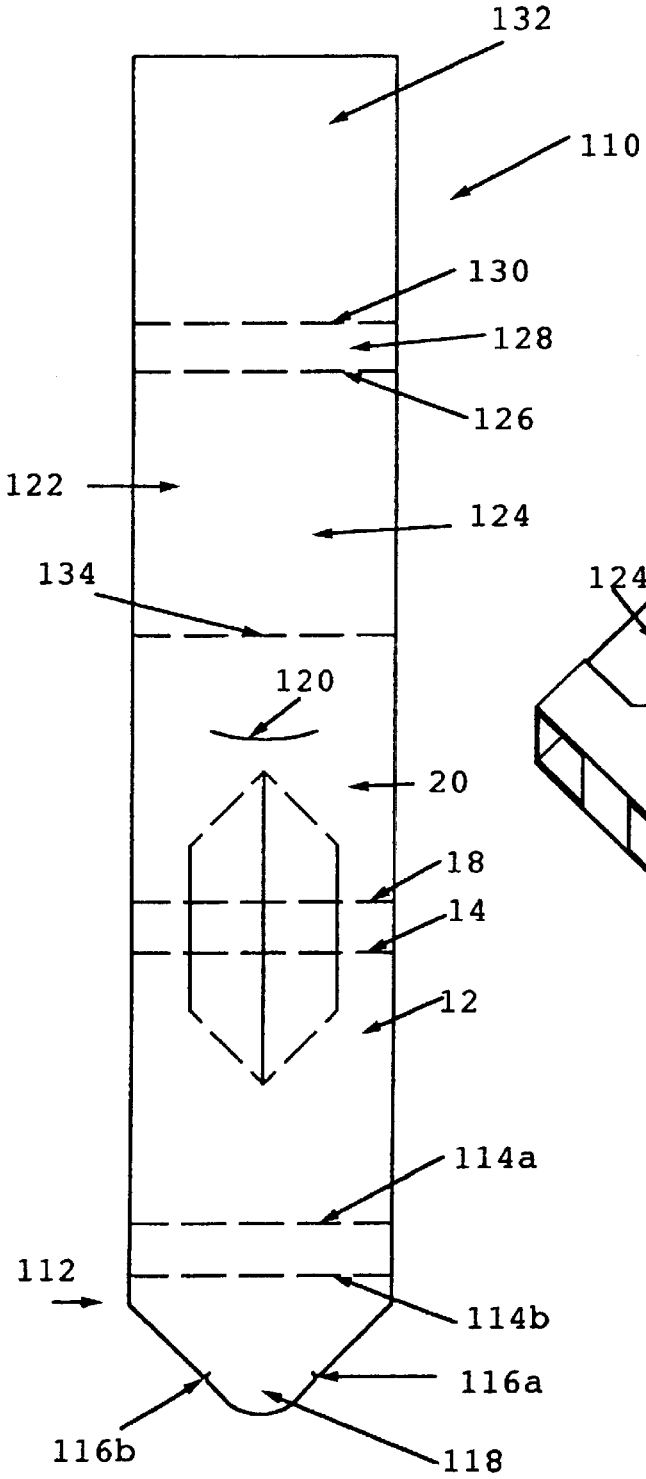
FIG. 14 is a plan view of a blank for a binder incorporating an integral sleeve.
Figure 15:
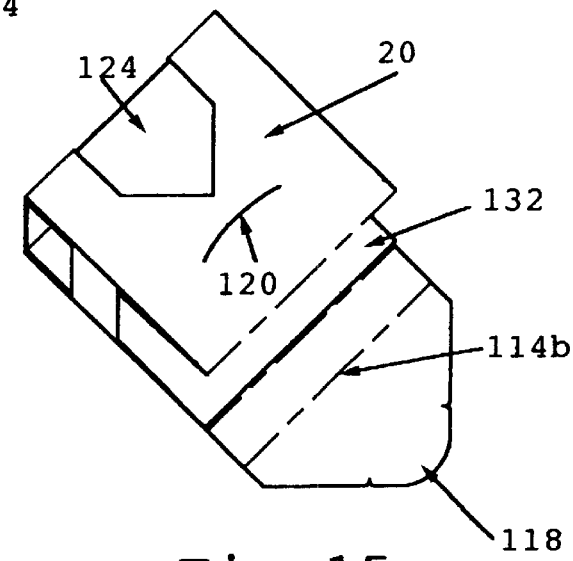
FIG. 15 is a perspective view of the binder part assembled from the blank of FIG. 14.

FIGS. 14 and 15 show a binder 110 respectively before and after its assembly from a blank in which each of the first and third panels 12, 20 has been extended.

The first panel 12 is extended to form a flap 112 the flap 112 comprises a pair of fold lines 114*a*, 114*b* as well as a pair of edge slits 116*a*, 116*b* helping to define a central tab 118 which is capable of being releasably connected.to a curved slit 120 formed in third panel 20.

The third panel 20 is extended to form an inner sleeve 122—the inner sleeve 122 comprises a first sleeve panel 124 divided by a first sleeve fold line 126 from a second sleeve panel 128 which is divided by a second sleeve fold 130 from a third sleeve panel 132. The separation between the first and second sleeve fold lines 126, 130 is slightly less than the separation between the first and second fold lines 14, 18. This allows the inner sleeve 122 to be folded such that the first sleeve panel 124 lies against the inside of the third panel 20, the second sleeve panel 128 lies against the inside of the second panel 16 and the third sleeve panel 132 lies against the inside of the first panel 12.

Preferably, the inner sleeve 122 is formed integrally with the remainder of the binder 110, to which it is connected by a fold line 134, rather than being formed separately from the remainder of the binder 110.

Figure 16:
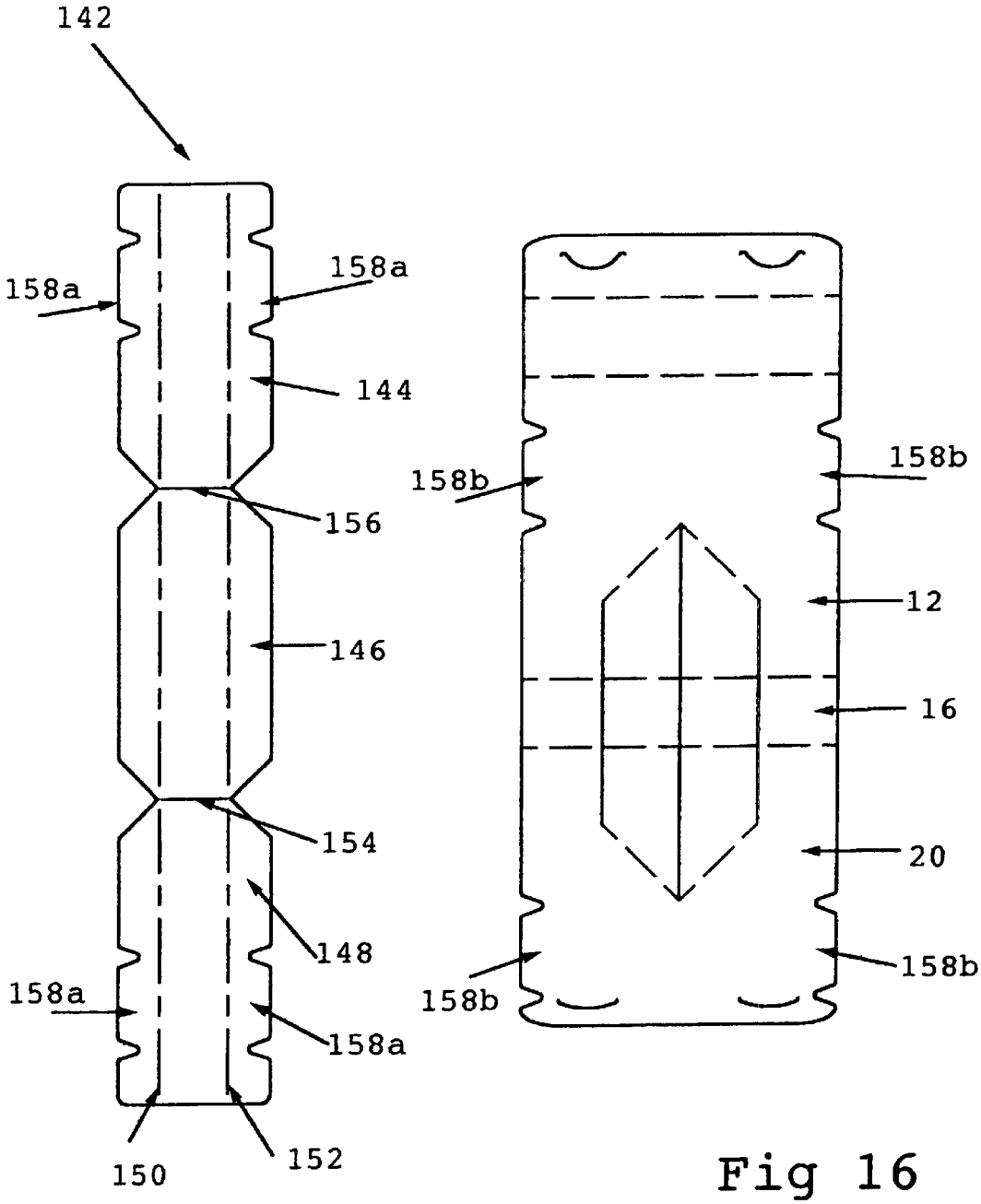
FIG. 16 is a plan view of two blanks for forming a binder with a separate spline.
Figure 17:
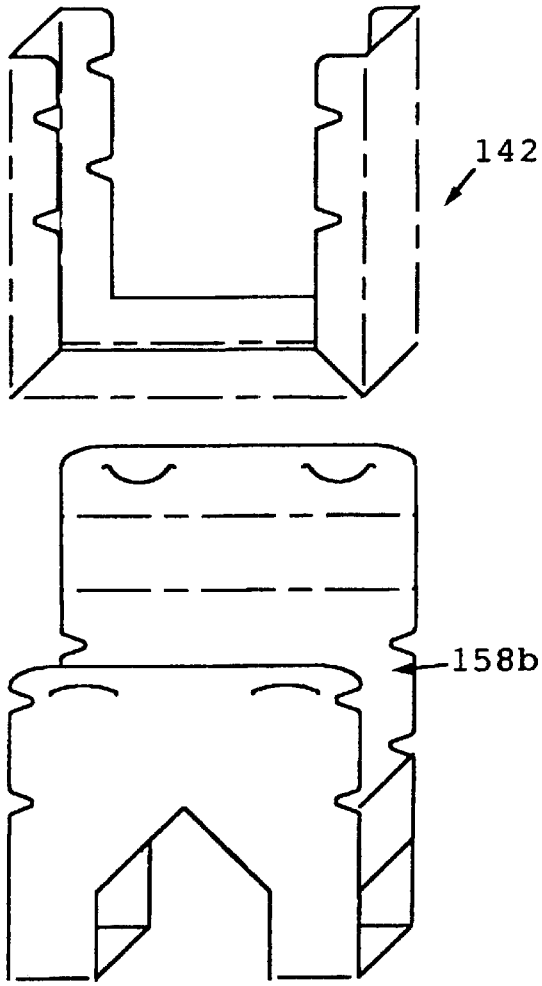
FIGS. 17 and 18 are perspective views showing sequential stages in the assembly of the binder and the separate spine from the blanks of FIG. 16.
Figure 18:
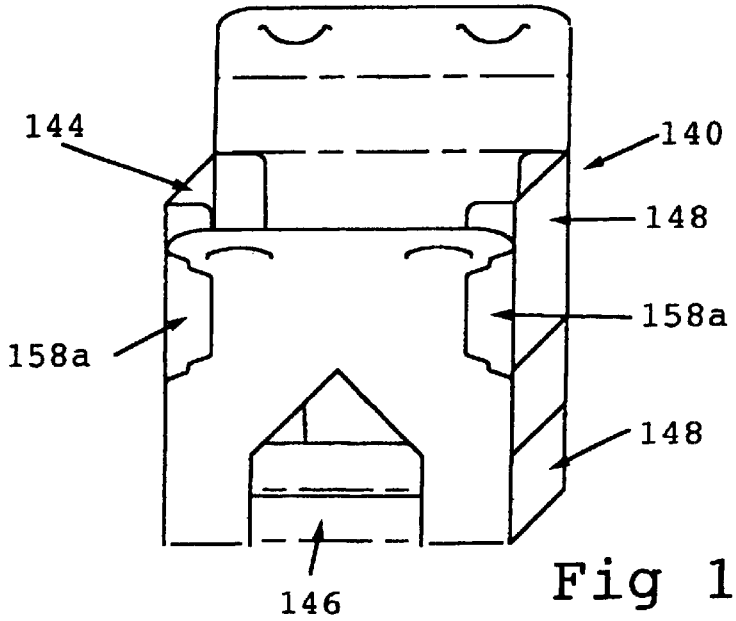

FIGS. 16 to 18 show a binder 140 respectively before, during and after its assembly from two blanks, with one of the blanks being similar to FIG. 1, and with the other of the blanks being utilised to form a separate inner spline 142 as shown best in FIG. 17.

The spline 142, which is again preferably formed of a plastics material such as polypropylene, has three panels 144, 146, 148 which are traversed by two long fold lines 150, 152 and are divided by two short fold lines 154, 156. The sides of all of the panels 144, 146, 148 are mitred near the ends of the fold lines 154, 156 to allow the spline 142 to have right angled corners. The sides of the outer panels 144, 148 are also notched to present opposed pairs of edge tabs 158*a* which are capable of being releasably connected to respective ones of opposed pairs of edge tabs 158*b* presented by the first and third panels 12, 20.

Clearly, the central panel 146 of the spline 142 can fill in the gap in the base of the binder 140, and the outer panels 144, 148 of the spline 142 can fill in the gaps in the sides of the binder 140.

Figure 19:
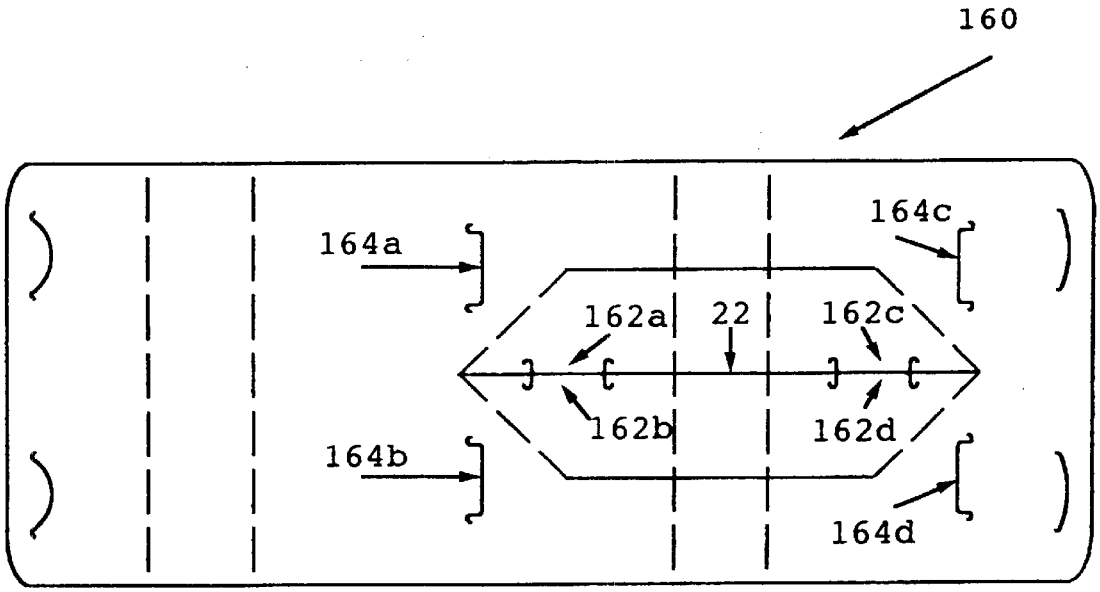
FIG. 19 is a plan view of a blank for a binder in which fasteners secure the first and second straps to the first and third panels.
Figure 20:
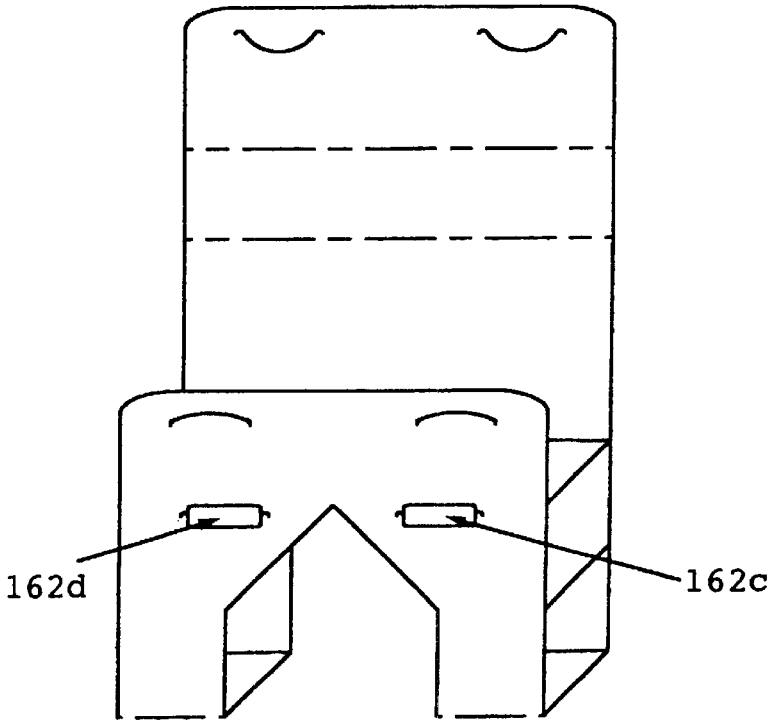
FIG. 20 is a perspective view of the binder part assembled from the blank of FIG. 19.

FIGS. 19 and 20 show a binder 160 which is similar to the binder 10 of FIGS. 1 to 4 but here with each of the first and second straps 32, 34 being positively connected to each of the first and third panels 12, 20. This allows the assembled condition of the binder 160 to be maintained, and not collapse, even when the binder 160 has not been completely filled. The positive connections are achieved by cross-slitting the central slit 22 to form four edge tabs 162*a*, 162*b*, 162*c*, 162*d* which can be secured to respective slits 164*a*, 164*b*, 164*c*, 164*d*.

Figure 21:
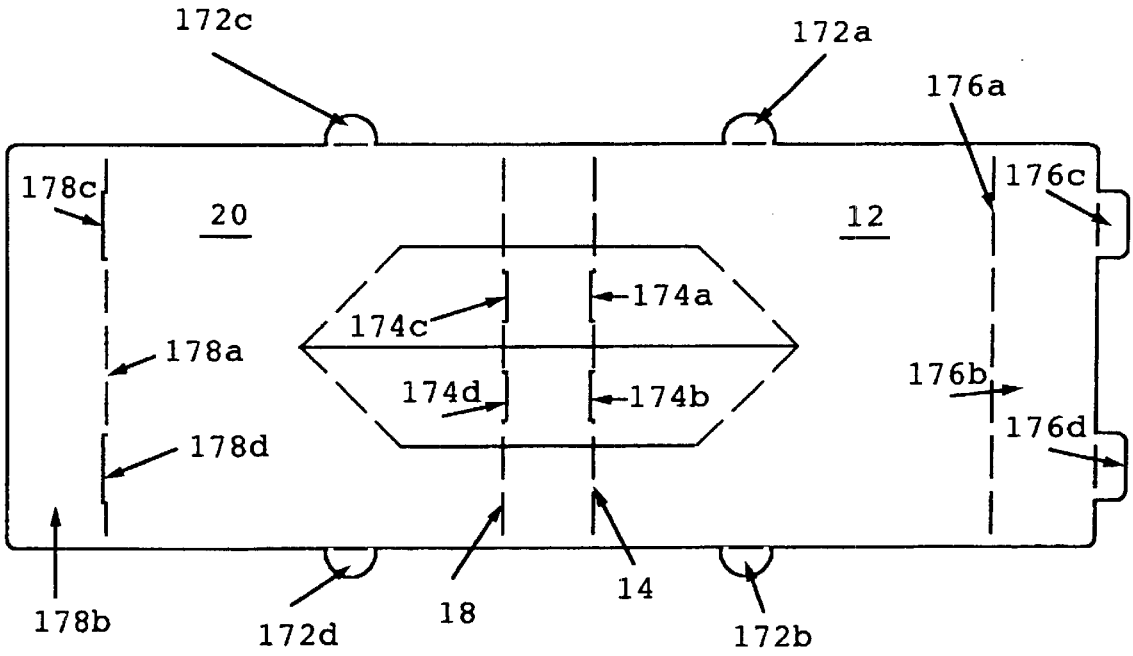
FIG. 21 is a plan view of a binder in which different fasteners secure the first and second straps to the first and third panels.
Figure 22:
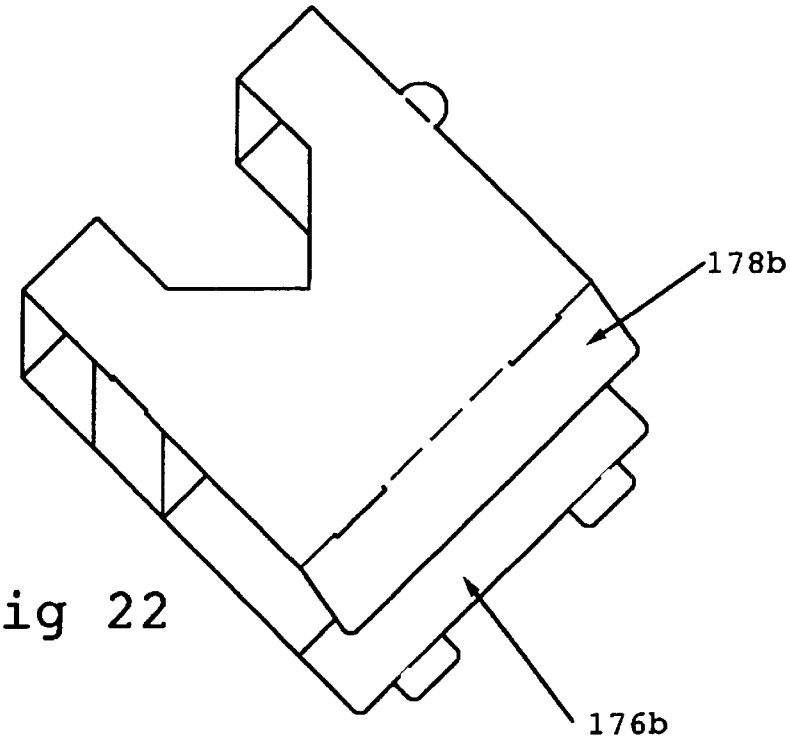
FIG. 22 is a perspective view of the binder part assembled from the blank of FIG. 21.

FIGS. 21 and 22 show a binder 170 which is similar to the binder 160 of FIGS. 19 and 20, in that each of the first and second straps 32, 34 is again positively connected to each of the first and third panels 12, 20, but here by the provision of four tabs 172*a*, 172*b*, 172*c*, 172*d* which can be releasably secured to respective slits 174*a*, 174*b*, 174*c*, 174*d*. It will be seen that the slits 174*a*, 174*b* are formed along the inner parts of the first fold line 14, and that the slits 174*c*, 174*d* are formed along the inner parts of the second fold line 18. It will also be seen that the top of the binder 170 is closable. This is achieved by extending the first panel 12 beyond a fold line 176*a* to form a panel 176*b* having edge tabs 176*c*, 176*d*, and by extending the third panel 20 beyond a fold line 178*a* to form a panel 178*b* having a pair of connecting slits 178*c*, 178*d*. When the edge tabs 176*c*, 176*d* are secured to the slits 178*c*, 178*d*, respectively, the panel 176*b* overlies the panel 178*b* to form a lid.

Figure 23:
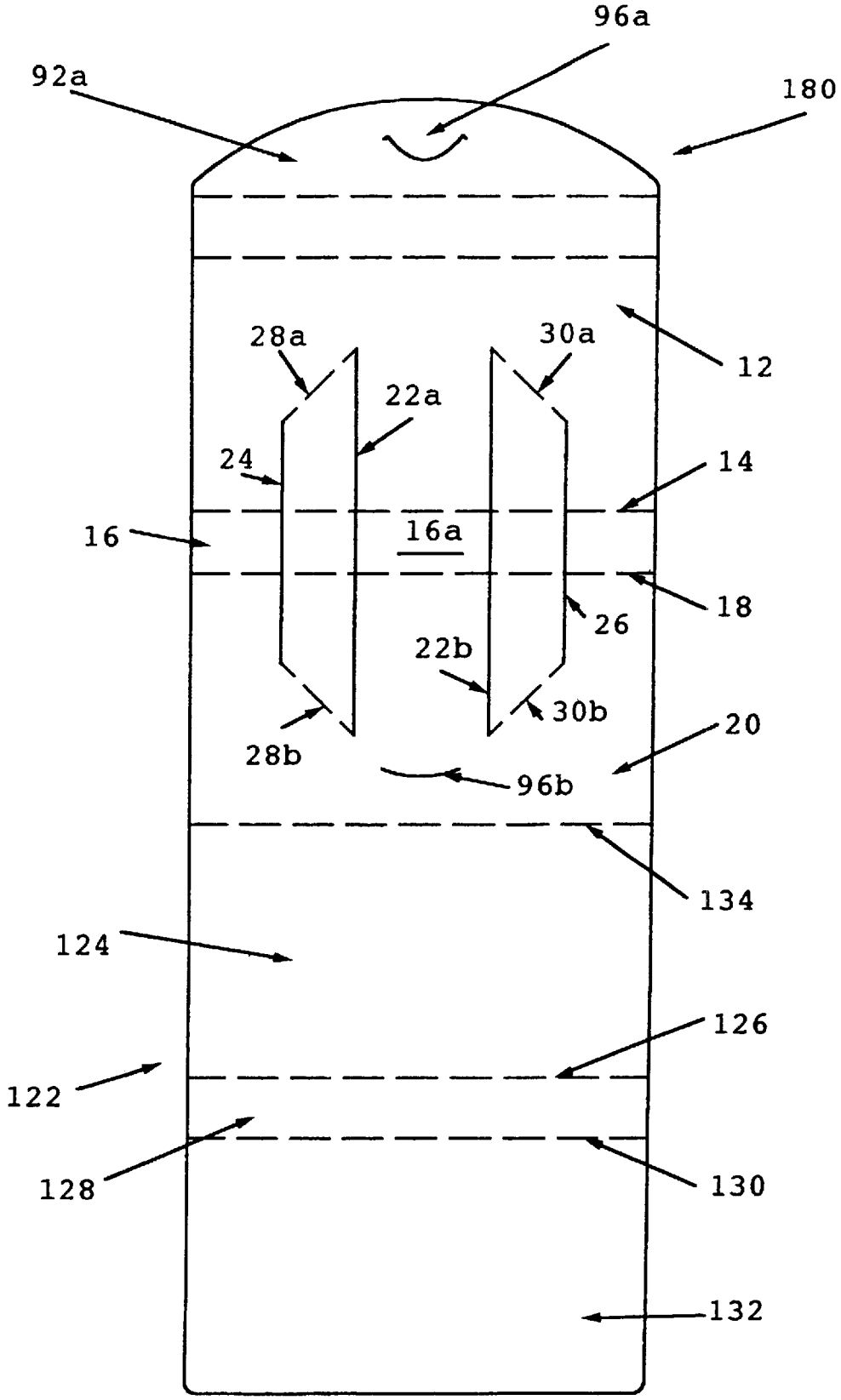
FIG. 23 is a plan view of blank for a binder in which the central slit is split into two.
Figure 24:
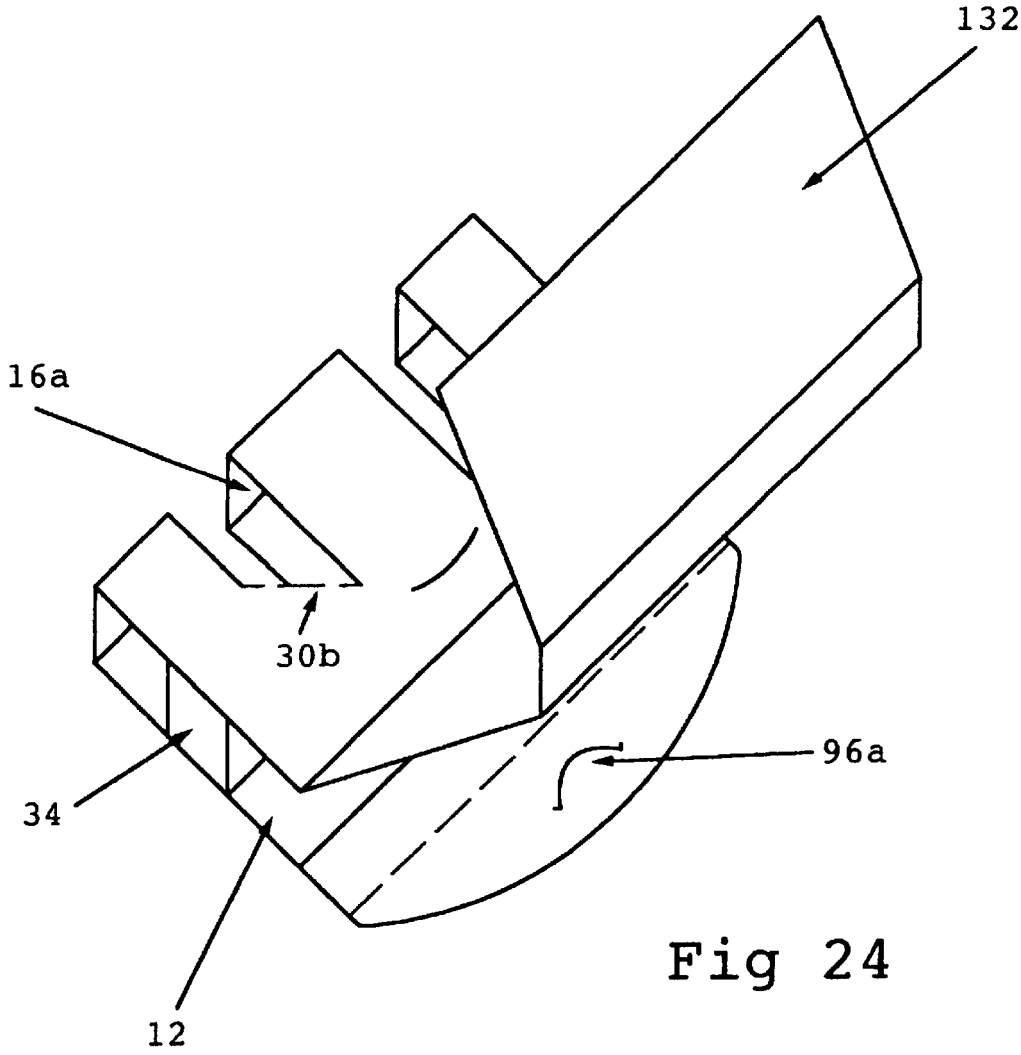
FIG. 24 is a perspective view of the binder part assembled from the blank of FIG. 23.

FIGS. 23 and 24 show a binder 180 which is similar to the binder 110 of FIGS. 14 and 15, in that there is an integral inner sleeve 122, but differs from the binder 110 of FIGS. 14 and 15 by effectively splitting the central slit 22 into two central slits 22*a*, 22*b*.

As a result, when the third panel 20 is folded about the outer parts of the first and second fold lines 14, 18, the material between the central slit 22*a* and the first outer slit 24 is folded about its associated crease lines 28*a*, 28*b* and the associated inner parts of the first and second fold lines 14, 18 to form a first strap 32. The material between the central slit 22*b* and the second outer slit 26 is folded about its associated crease lines 30*a*, 30*b* and the associated inner parts of the first and second fold lines 14, 18 to form a second strap 34. This leaves a central part 16*a* of the second panel 16 in alignment with the rest of the base, formed as before by the outer parts of the second panel 16, and thereby provides additional support for wide contents.

The binder 180 is closable by a curved flap 92*a* having a slit 96*a*, as in the binder 90 of FIG. 11, the slit 96*a* being releasably connectable to a slit 96*b* formed in the third panel 20.

FIGS. 25 to 29 show a binder 190 which is similar to the binder 70 of FIGS. 7 to 9 in that a pair of double catches 76 provide assured closing.

However, the first fold line 14 is here split into a series of first fold lines 14*a*, 14*b*, 14*c*, 14*d* of which the first fold line 14*a* is coincident with the second fold line 18. This allows the separation between the first and third panels 12, 20 in the assembled binder 190 to be adjusted depending upon which of the first fold lines 14*a*, 14*b*, 14*c*, 14*d* is utilised. As it is the separation between the first and third panels 12, 20 which determines the storage capacity, splitting the first fold line 14 into a series of first fold lines 14*a*, 14*b*, 14*c*, 14*d* enables the storage capacity to be adjusted in a series of set increments.

To allow the central parts of the first and second straps 32, 34 to continue to act as the sides of the assembled binder 190, all of the three slits 22, 24, 26 are capable of being lengthened by selective breaking of frangible connecting webs 192. There is a corresponding series of crease lines 194*a*, 194*b*, 194*c*, 194*d* between one end of the central slit 22 and the adjacent end of the first outer slit 24 as well as a corresponding series of crease lines 196*a*, 196*b*, 196*c*, 196*d* between said one end of the central slit 22 and the adjacent end of the second outer slit 26. To allow for concertina-like closing, there can be a large range of fold lines 74*a* to 74*g* separating the first panel 12 from pairs of tabs 78*a* in flap 72 but there need only be a smaller range of slots 78*b* in third panel 20.

Figure 25:
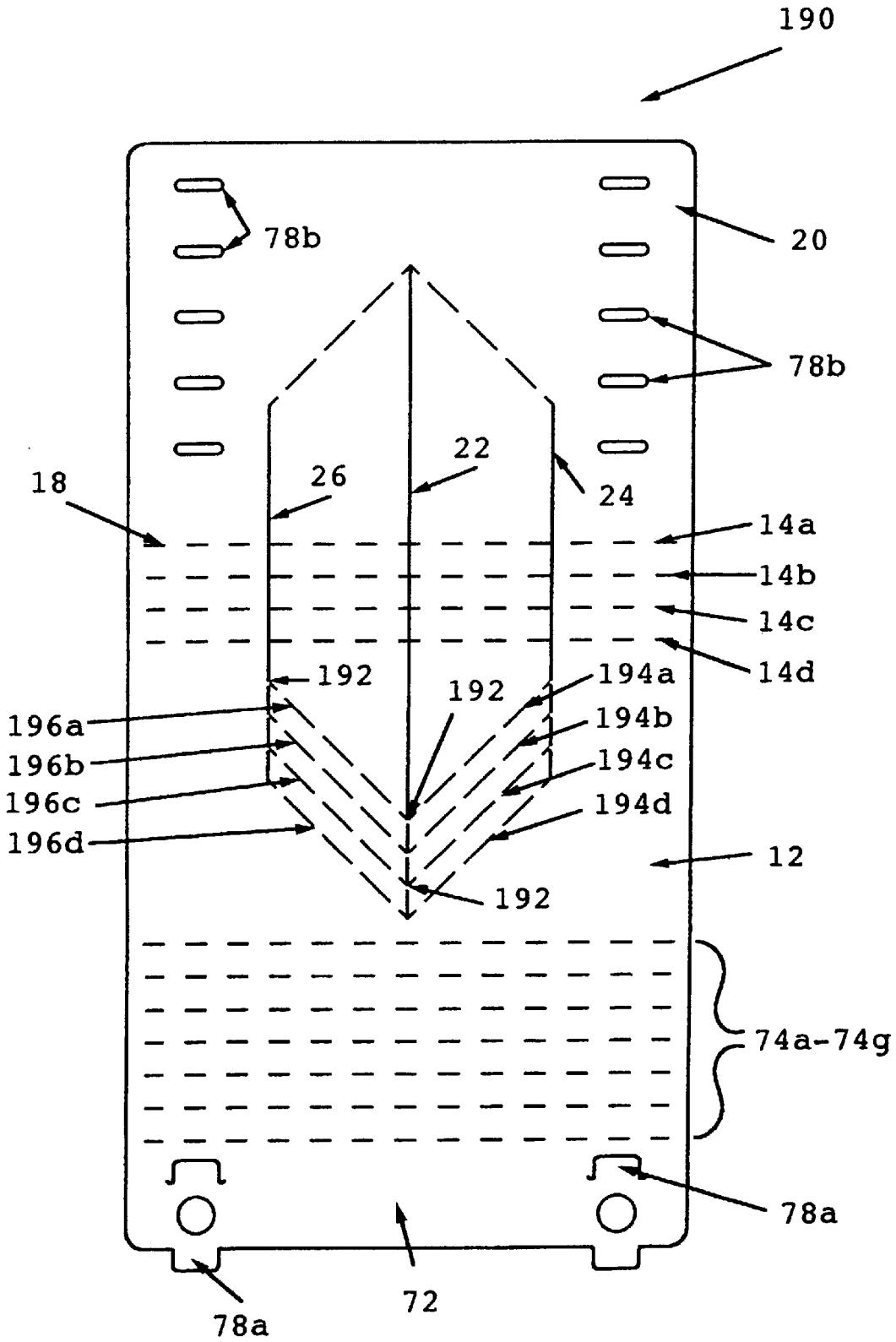
FIG. 25 is a plan view of a blank for a binder having an adjustable storage capacity.
Figure 26:
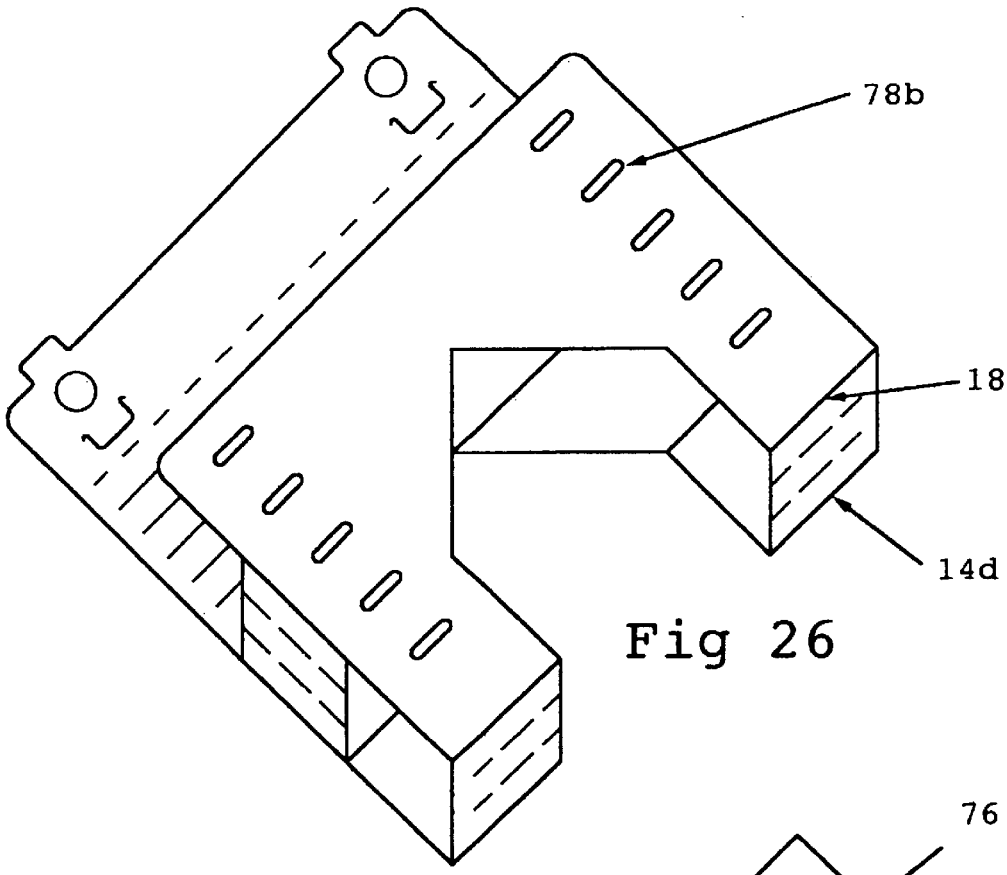
FIGS. 26 to 29 are perspective views showing stages in the assembly of binders having different storage capacities from the blank of FIG. 25.
Figure 27:
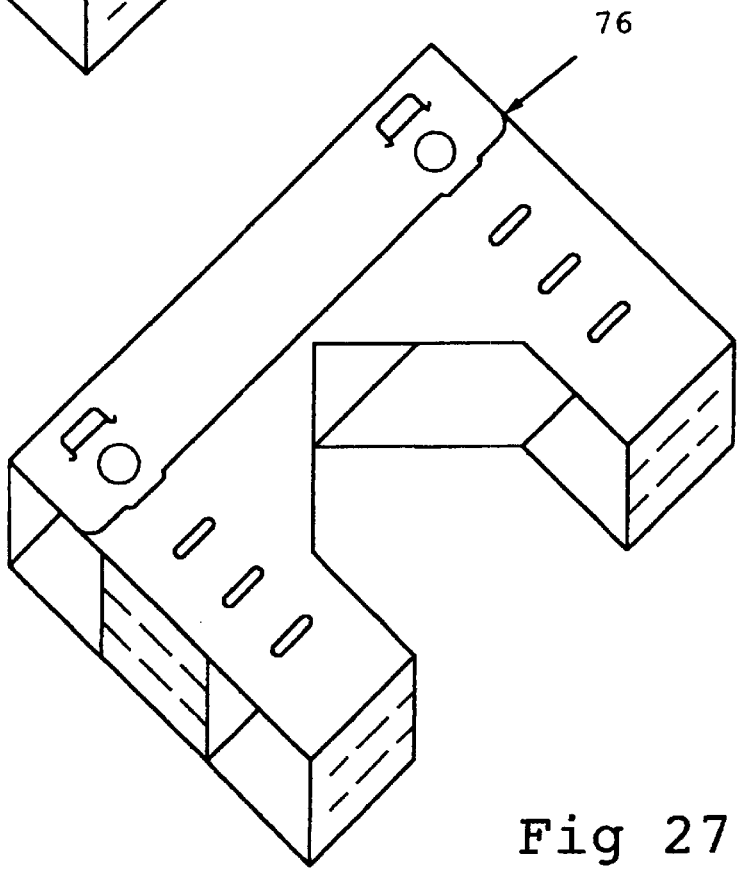
Figure 28:
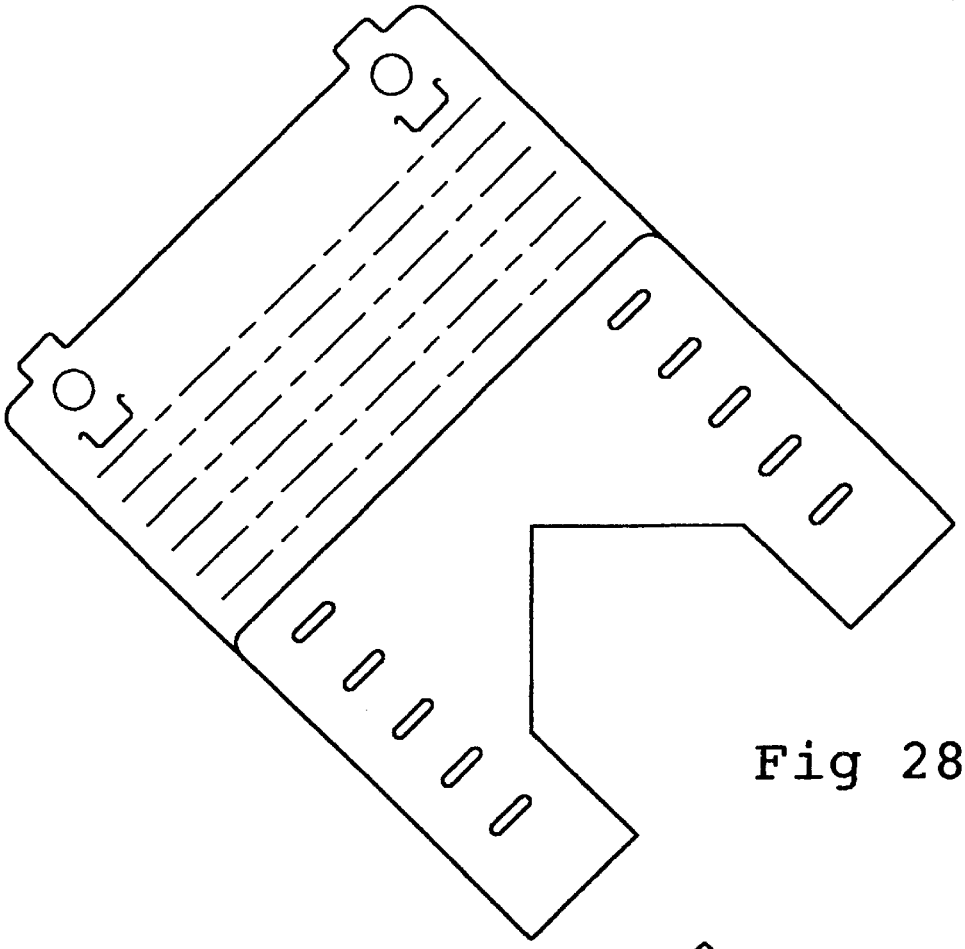
Figure 29:
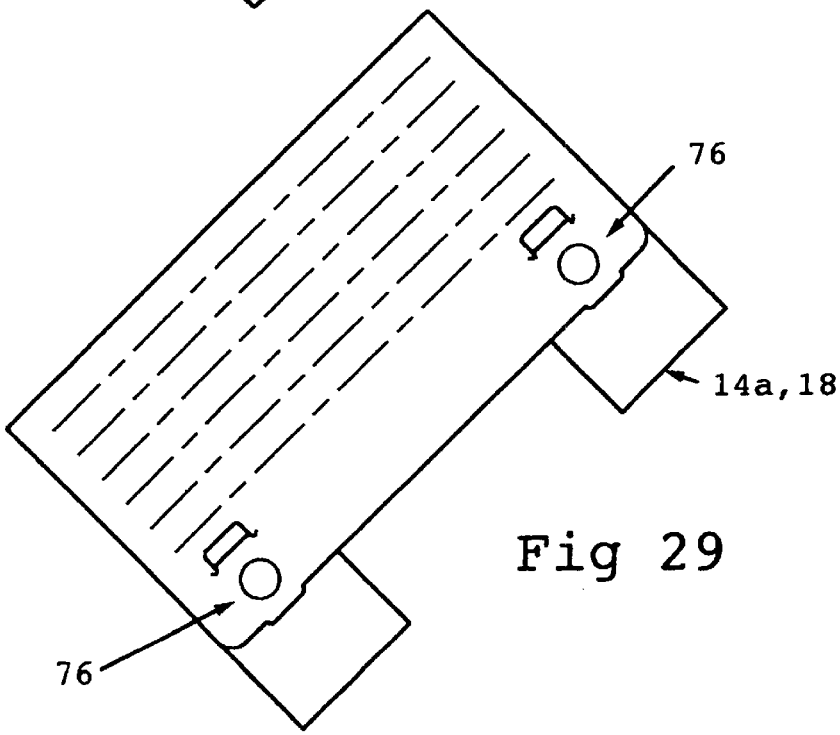

From the structure of the blank shown in FIG. 25, it will be appreciated that FIGS. 26 and 27 show a binder 190 utilising the fourth fold line 14*d* and the crease lines 194*d*, 196*d* to give a maximum storage capacity, with FIGS. 28 and 29 showing a binder 190 utilising the first fold line 14*a* and the crease lines 194*a*, 196*a* to give a minimum storage capacity.

Figure 30:
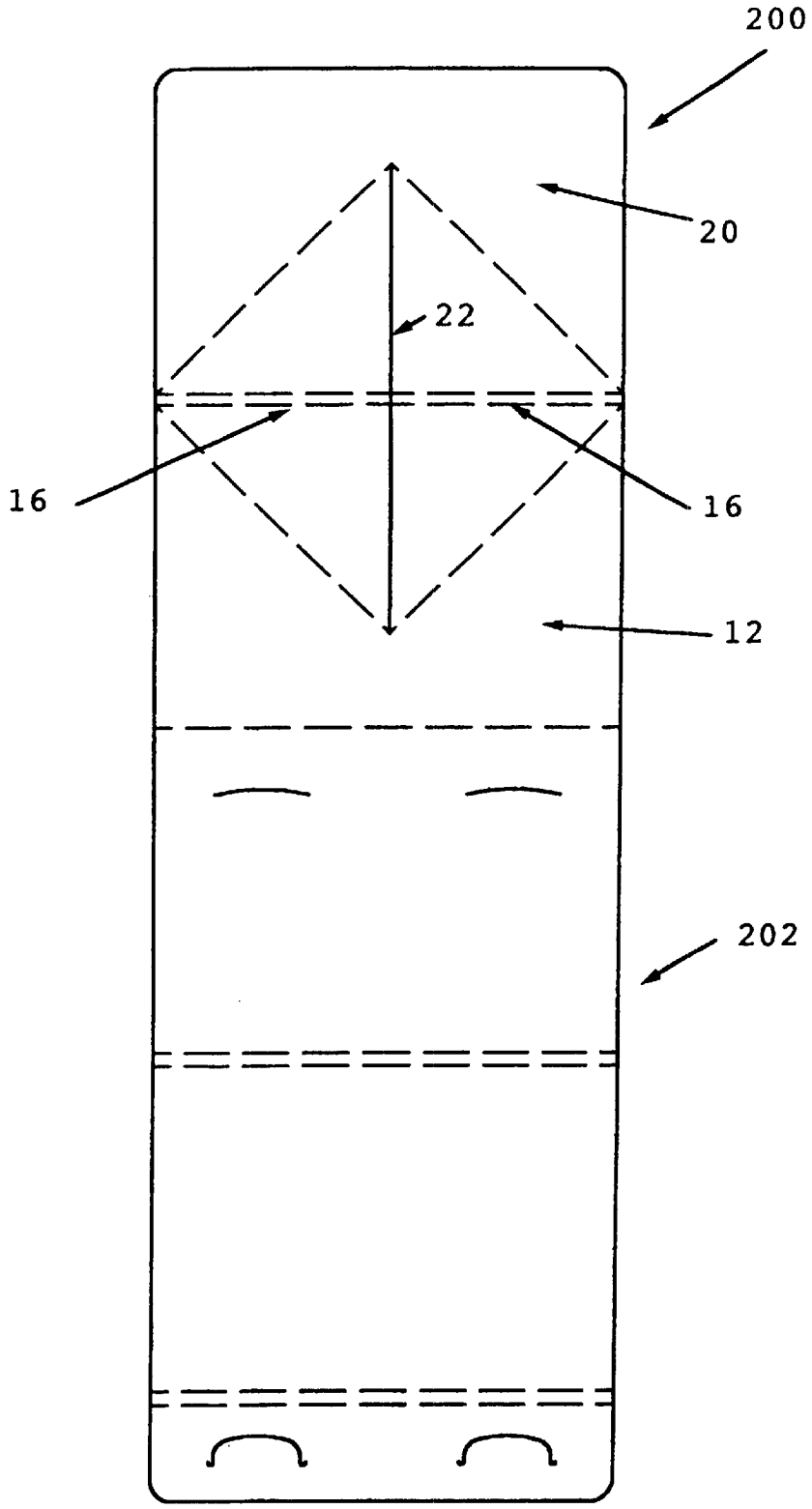
FIG. 30 is a plan view of a blank for a binder having a different strap structure.
Figure 31:
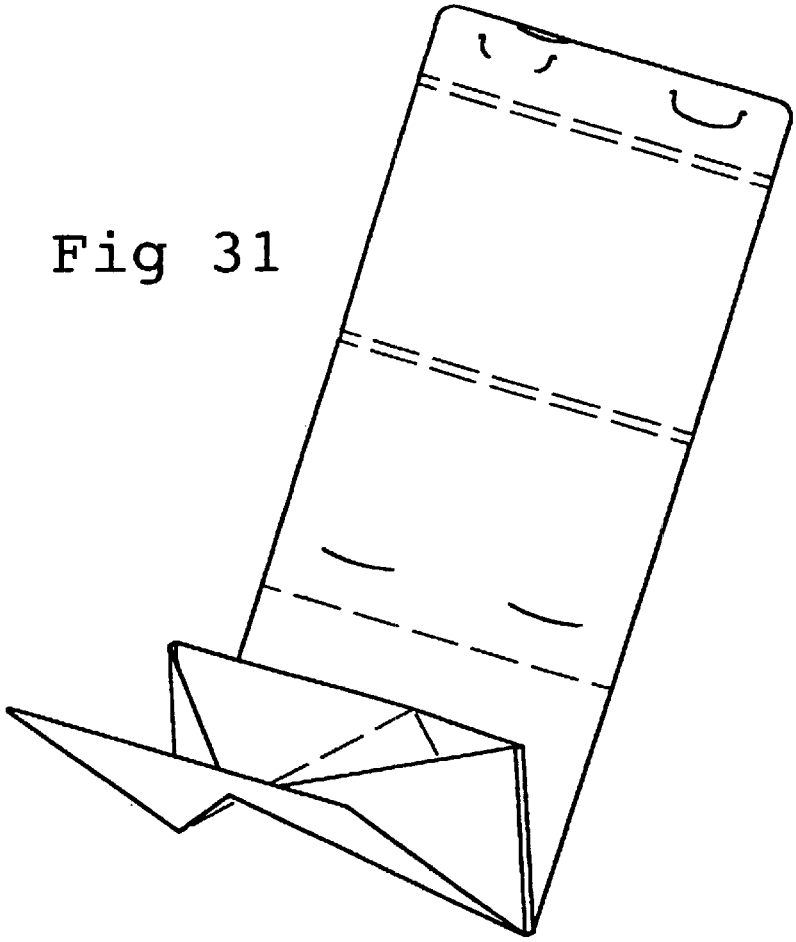
FIGS. 31 and 32 are perspective views showing the manner of assembly of the binder from the blank of FIG. 30.
Figure 32:
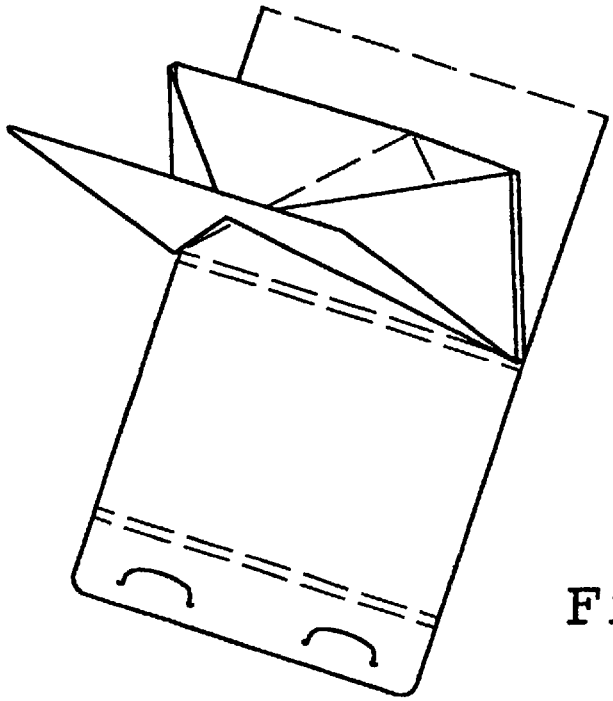

FIGS. 30 to 32 show a binder 200 which can be regarded as being based on the binder 110 of FIGS. 14 and 15 but with a sleeve 202 being integral with the first panel 12 and with the outer slits 24, 26 having migrated outwards to be coincident with the side edges of the binder 200. In this situation, the second panel 16 between the first and second fold lines 14, 18 is just split into two. One half of the second panel 16 acts as the central part of the strap 32 and the other half of the second panel 16 acts as the central part of the strap 34. The sleeve 202 is then wrapped around the open sleeve formed from the first, second and third panels 12, 16, 20 in order to maintain the assembled condition of the binder 200. In another arrangement, not illustrated, the sleeve 202 could be inserted into the open sleeve to maintain the assembled condition of the binder 200.

Figure 33:
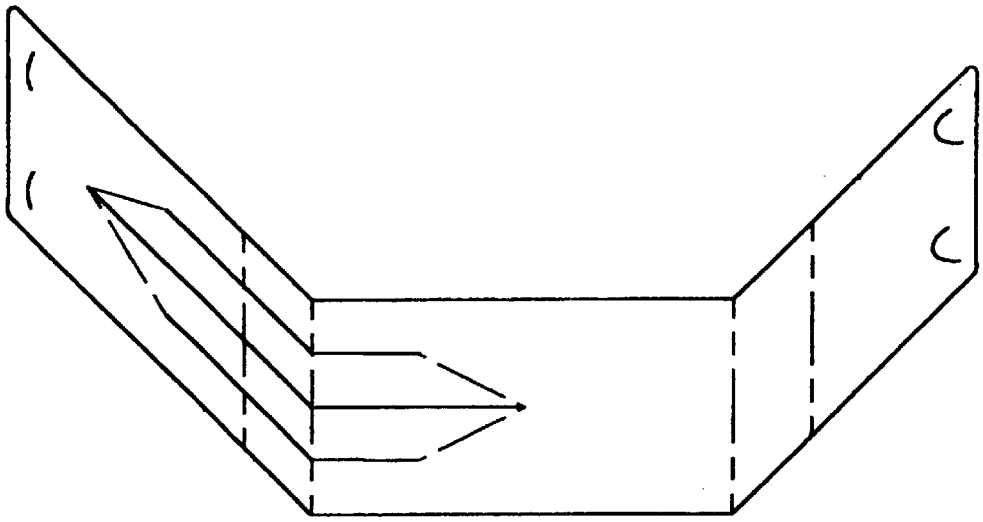
FIGS. 33 to 35 are schematic views illustrating how a binder can be folded to be of equivalent size (in elevation) to an article to be stored by the binder.
Figure 34:
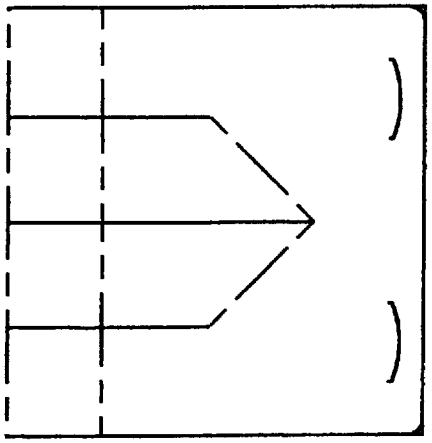
Figure 35:
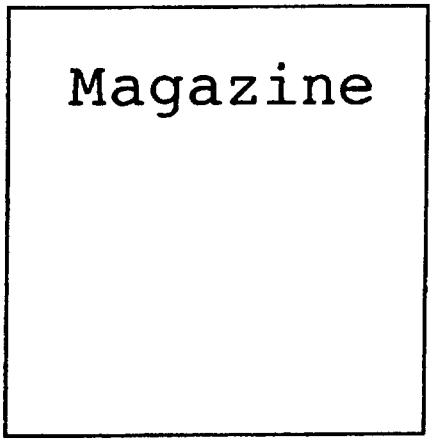

FIGS. 33 to 35 illustrate how any of the binders can be simply folded around appropriate fold lines to give an overall elevation corresponding to that of an article to be stored thereby allowing easy packaging of the binder with the article to be stored.

The binders of the present invention are preferably formed of plastics materials (although materials other than plastics materials would be possible) in which structural elements such as slits, fold lines and crease lines are preferably formed by conventional die cutting technology (although again other methods of forming such structural elements would be possible).

Thus, each of the binders illustrated in the accompanying drawings could be formed from a sheet of polypropylene of, for example, 0.5 mm thickness, with all of the slits having been fully pre-formed by cutting rules and with all of the fold lines and the crease lines having been fully pre-formed by creasing rules, whereby each of the binders is capable of being supplied from a manufacturer in a ready-to-be assembled condition.

The dimensions and indeed the proportions will clearly depend upon the particular circumstances i.e. the particular articles to be stored in the binders.

Figure 36:
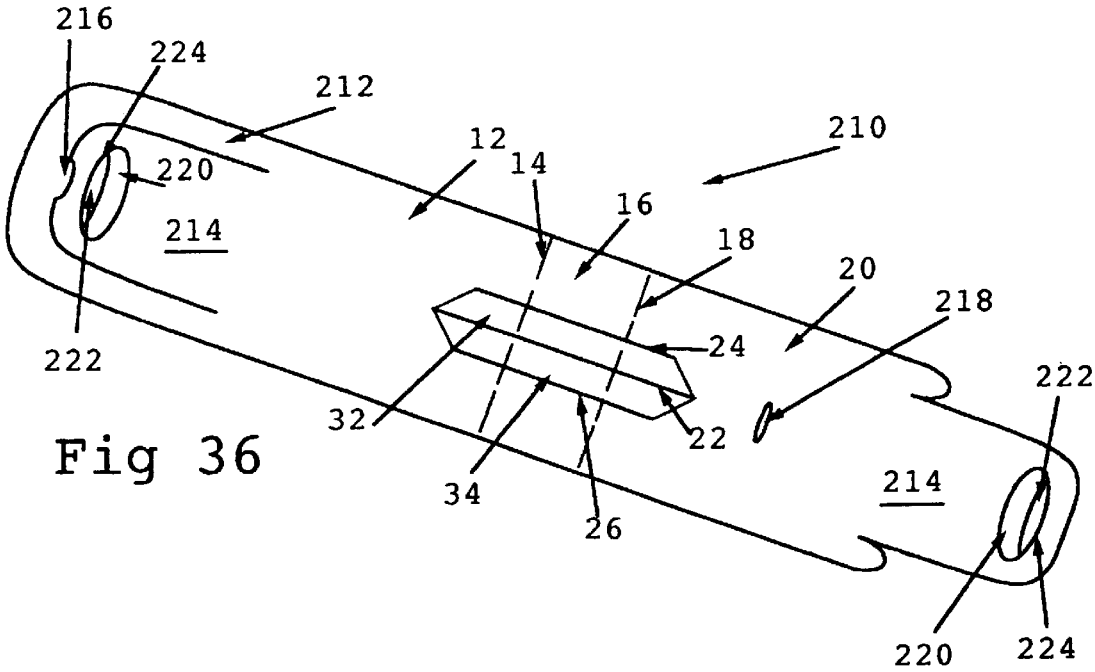
FIG. 36 is a plan view of a blank for a binder, primarily for use with wine bottles.

FIG. 36 shows a blank for a binder 210, according to the present invention, which is particularly suitable for use with wine bottles.

The basic structure of the binder 210 is as previously disclosed—thus, a first panel 12 is divided by a first fold line 14 from a second panel 16 which is divided by a second fold line 18 from a third panel 20.

It will be seen that the first fold line 14 is parallel or substantially parallel to the second fold line 18. It will also be seen that the first fold line 14 and the second fold line 18 are intersected by a slit 22 which is located centrally between a pair of outer slits 24 and 26.

The central slit 22 is longer than the first outer slit 24 and the second outer slit 26.

During assembly, as disclosed in detail hereinbefore, the material between the central slit 22 and the first outer slit 24 is folded about associated crease lines and inner parts of the first and second fold lines to form a first strap 32.

Similarly, the material between the central slit 22 and the second outer slit 26 is folded about associated crease lines and inner parts of the first and second fold lines to form a second strap 34.

The binder 210 differs from those previously disclosed by the provision of a fastening flap 212 and a pair of carrying handles 214.

The fastening flap 212 is provided with a securing tab 216 which, during assembly, is locatable with a securing slit 218.

Each of the carrying handles 214 includes an opening 220 and a finger flap 222 which is manipulatable about a creased hinge 224 to allow more comfortable carrying.

Figure 37:
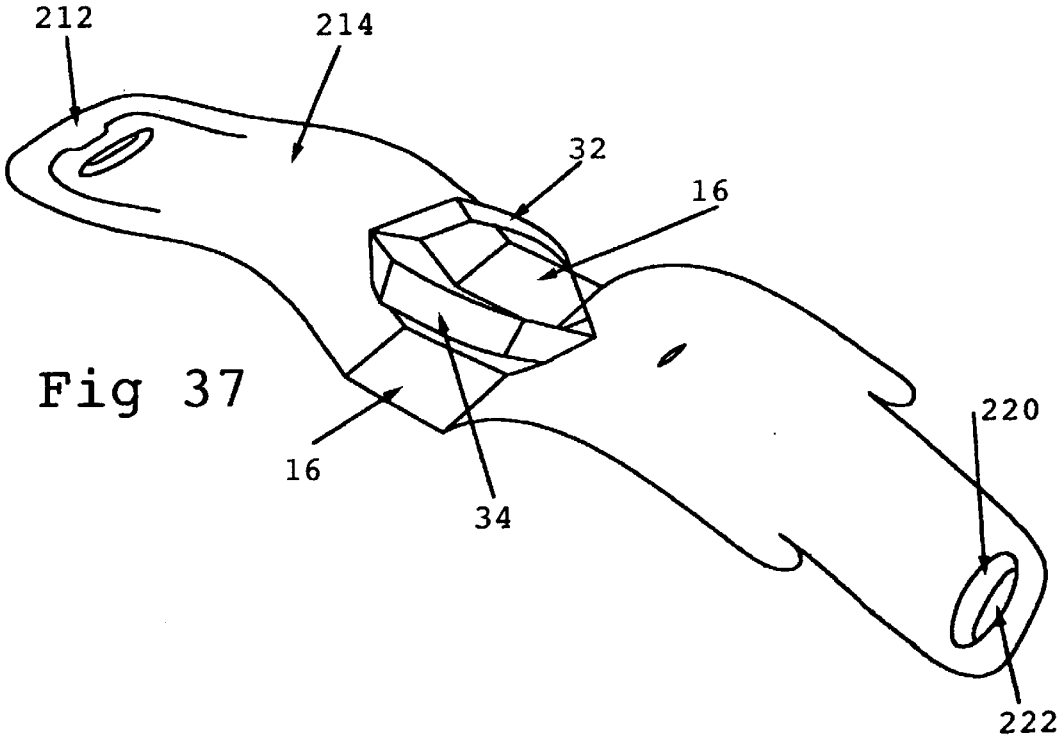
FIG. 37 is a perspective view showing the blank of FIG. 36 when partly erected.
Figure 38:
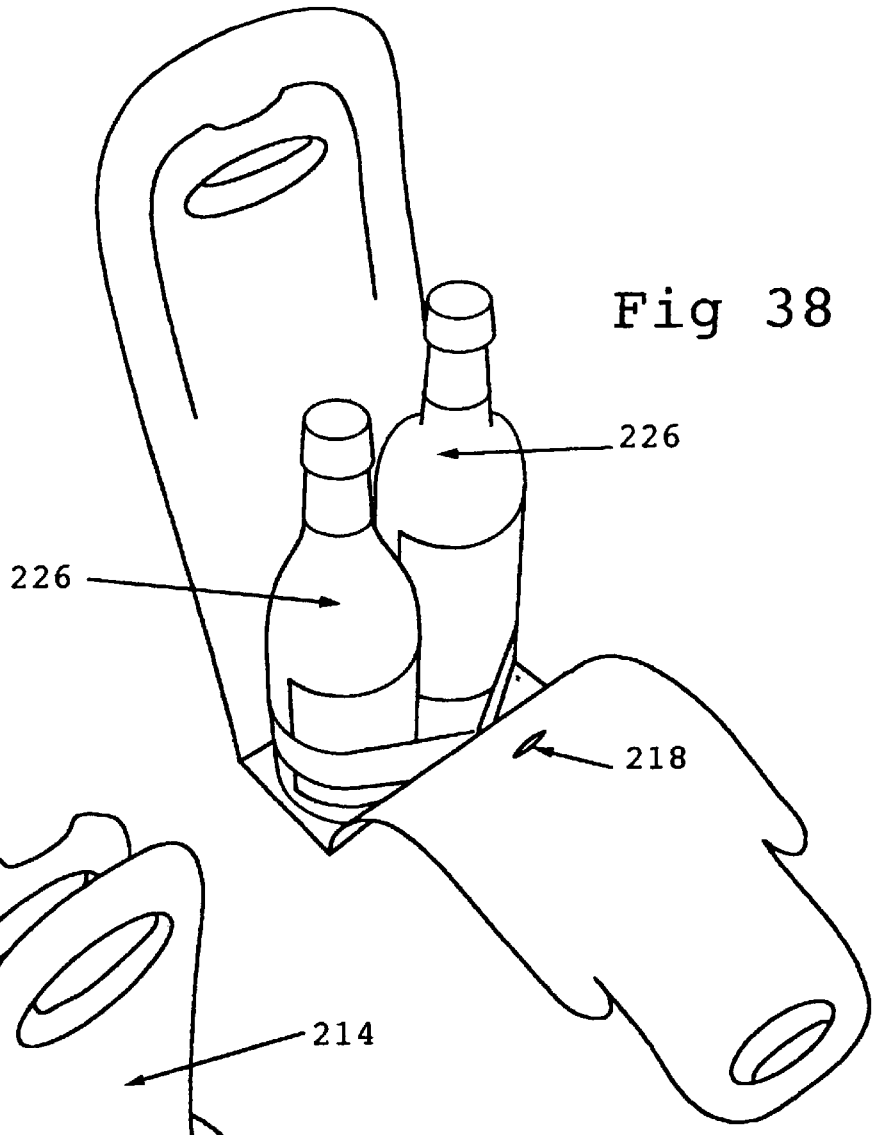
FIGS. 38 and 39 are perspective views showing sequential stages in the assembly of the binder from the blank of FIG. 36 with wine bottles.
Figure 39:
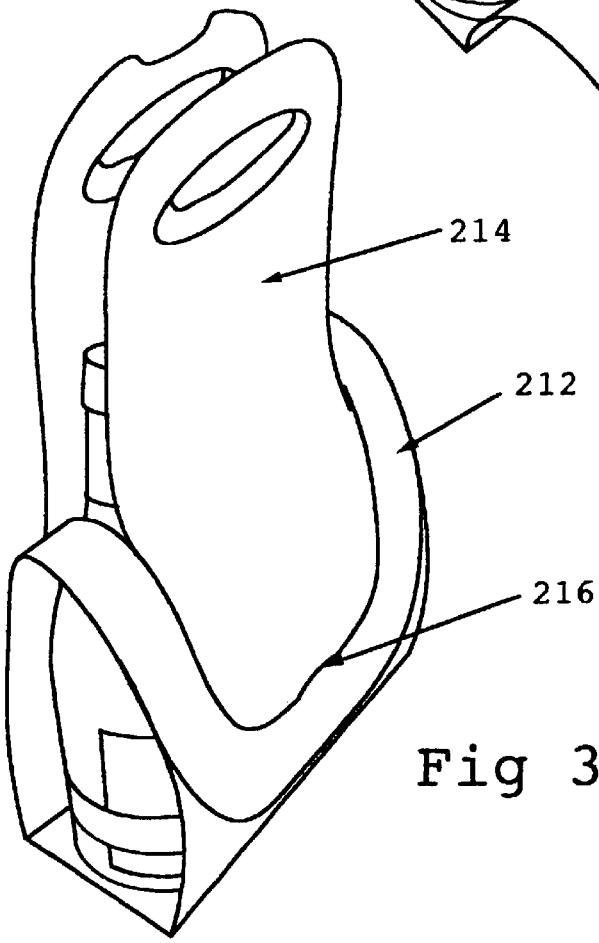

As will be expected, the blank is first partly erected to form the first strap 32 and the second strap 34 as shown in FIG. 37, wine bottles 226 are then stood on the outer parts of the second panel 16 constituting the base as shown in FIG. 38, and finally the fastening flap 212 is secured in position as shown in FIG. 39.

Figure 40:
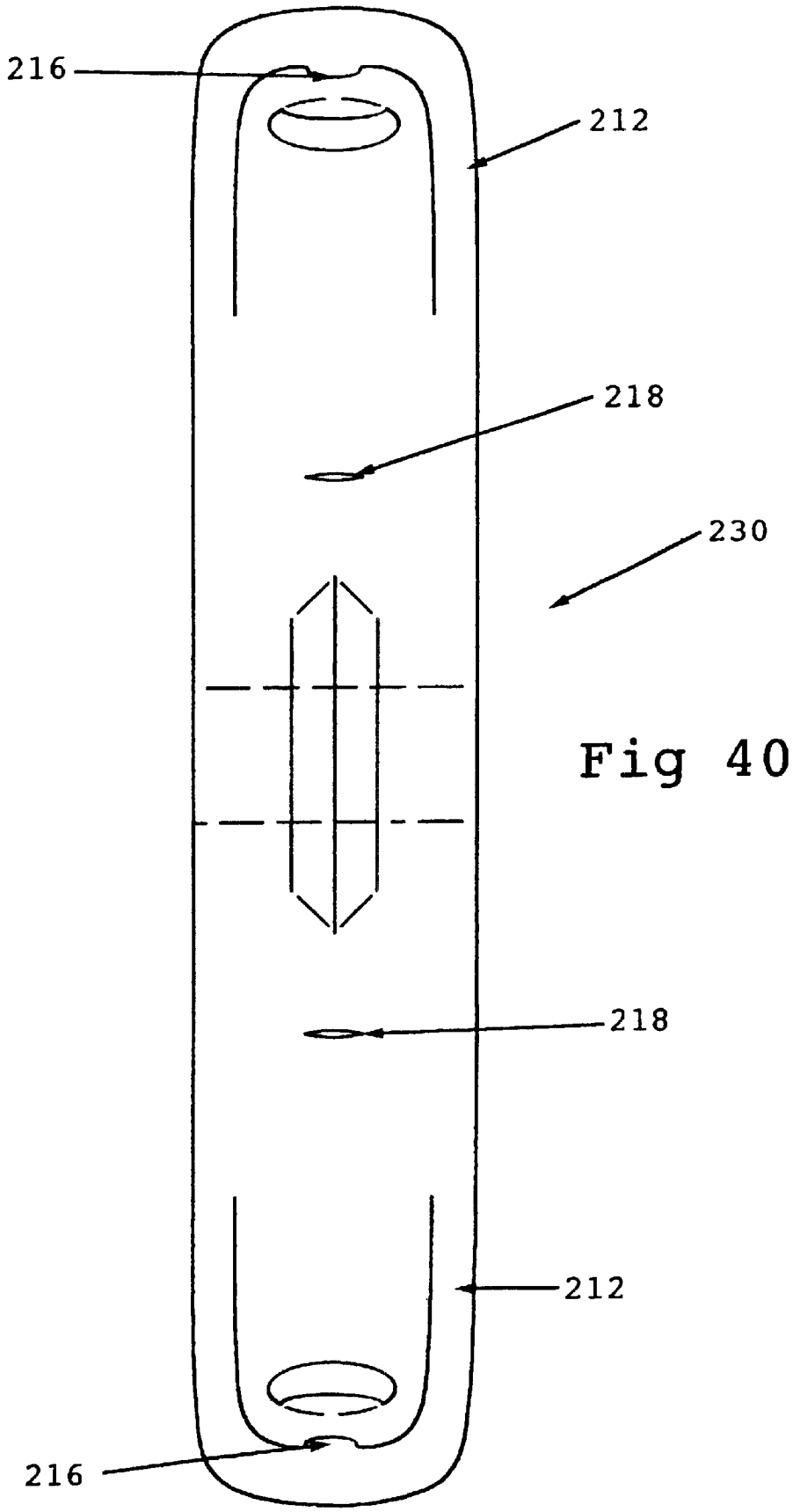
FIG. 40 is a plan view of a blank for a binder, primarily for use with wine bottles, in which the fastening flap is duplicated.

FIG. 40 shows a blank for a binder 230, according to the present invention, which is extremely similar to the binder 210 except that there are two of the fastening flaps 212 and thus two of the securing tabs 216 as well as two of the securing slits 218.

Figure 41:
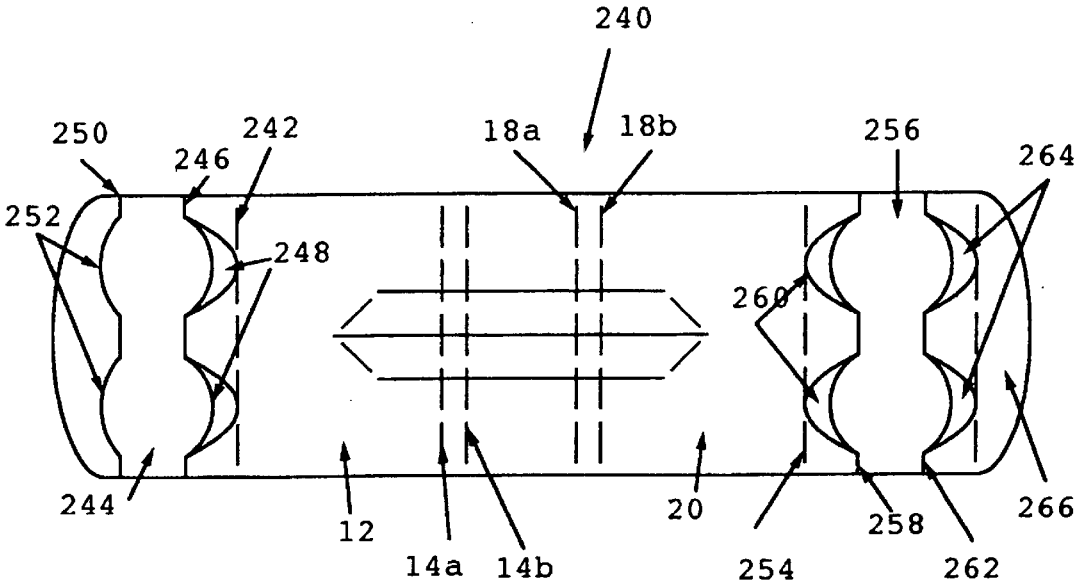
FIG. 41 is a plan view of a blank for a binder, primarily for use with beverage cans.

FIG. 41 shows a blank for a binder 240, according to the present invention, which is particularly suitable for use with beverage cans.

The first panel 12 is extended past a fold line 242 to an end face 244 including a fold line 246 interrupted by a pair of crescent-shaped cut-outs 248 as well as a fold line 250 interrupted by a pair of arc-shaped slits 252.

The third panel 20 is extended past a fold line 254 to an end face 256 including a fold line 258 interrupted by a pair of crescent-shaped cut-outs 260 as well as another fold line 262 interrupted by another pair of crescent-shaped cut-outs 264.

The end face 256 is itself hinged to an end flap 266.

The first fold line is formed from two parallel folds 14*a*, 14*b* and the second fold line is formed from two parallel folds 18*a*, 18*b* so that the bottom edges of the binder 240 are effectively bevelled.

Figure 42:
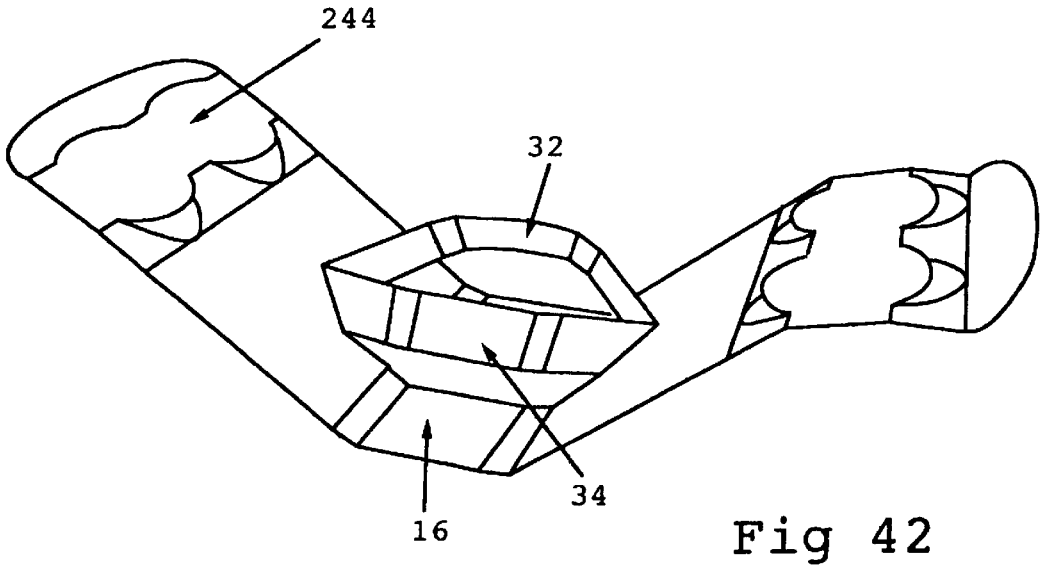
FIG. 42 is a perspective view showing the blank of FIG. 41 when partly erected.

During assembly, the blank is first partly erected to form the first strap 32 and the second strap 34 as shown in FIG. 42, before a pair of beverage cans 268 are stood on the outer parts of the second panel 16 constituting the base as shown in FIG. 43.

During continued assembly, the end face 256 is folded over the beverage cans 268 as shown in FIG. 44, and then the end face 244 is folded over the end face 256 allowing the arc-shaped slits 252 to engage with upper rimmed edges of the beverage cans 268 as shown in FIG. 45.

Figure 46:
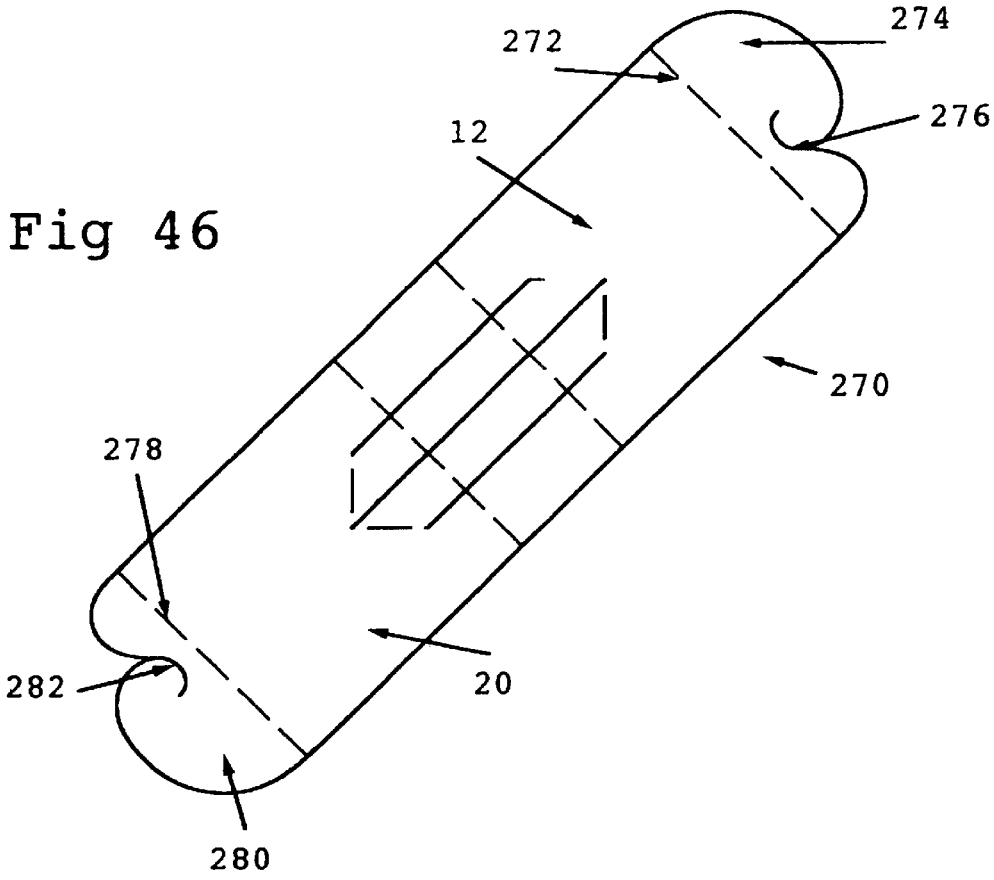
FIG. 46 is a plan view of a blank for a binder, primarily for use with cosmetic bottles.

FIG. 46 shows a blank for a binder 270, according to the present invention, which is particularly suitable for use with cosmetic bottles.

The first panel 12 extends beyond a fold line 272 to a twist flap 274 including an arcuate slit 276, and the third panel 20 extends in a similar manner beyond a fold line 278 to a twist flap 280 including an arcuate slit 282.

Figure 47:
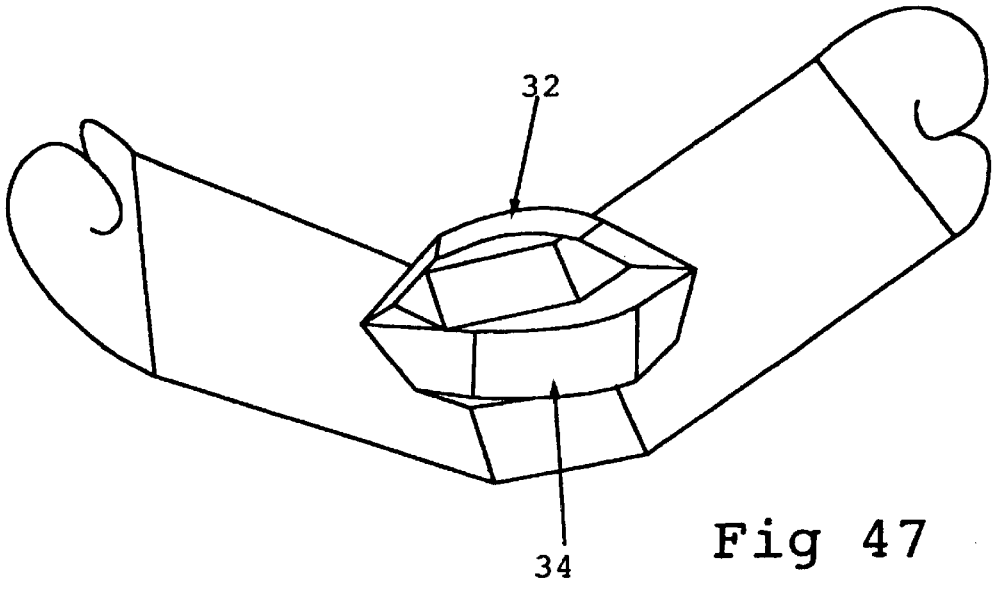
FIG. 47 is a perspective view showing the blank of FIG. 46 when partly erected.
Figure 48:
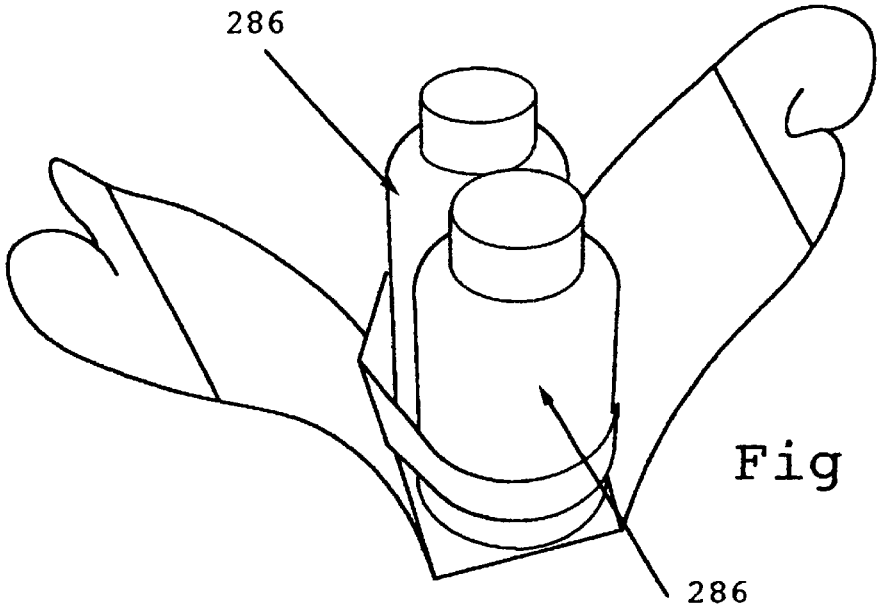
FIGS. 48 and 49 are perspective views showing sequential stages in the assembly of the binder from the blank of FIG. 46 with cosmetic bottles.
Figure 49:
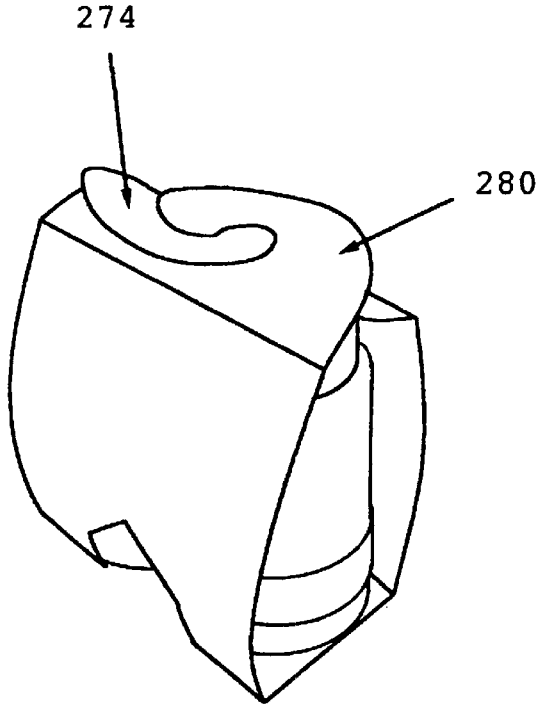

The intended manner of use with a pair of cosmetic bottles 286 will be apparent from FIGS. 47, 48 and 49.

In general, any embodiment of the present invention is likely to use much less material than blanks used for conventional box-type constructions.

Figure 50:
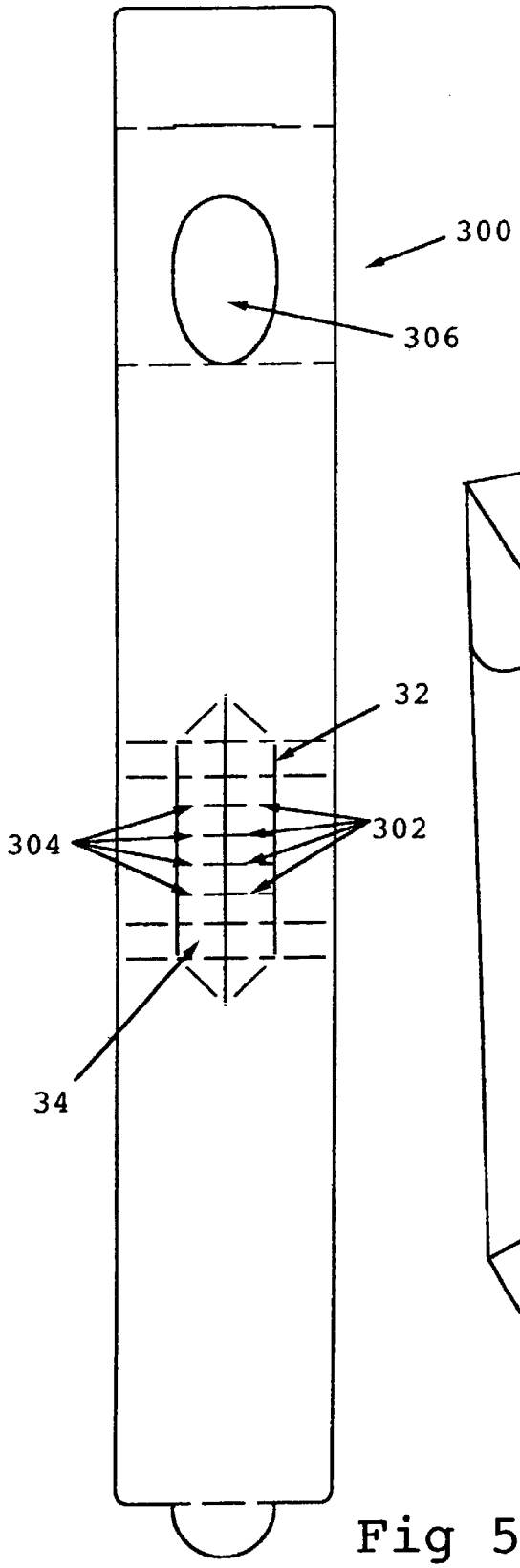
FIG. 50 is a plan view of a blank for a binder, primarily for use with a single wine bottle.

FIG. 50 shows a blank for a binder 300, according to the present invention, which is particularly suitable for use with a single wine bottle. The basic structure of the binder 300 is as previously disclosed and will therefore not be described in detail. The main difference from the previous disclosure is that the binder 300 is formed of card rather than a plastics material.

Figure 51:
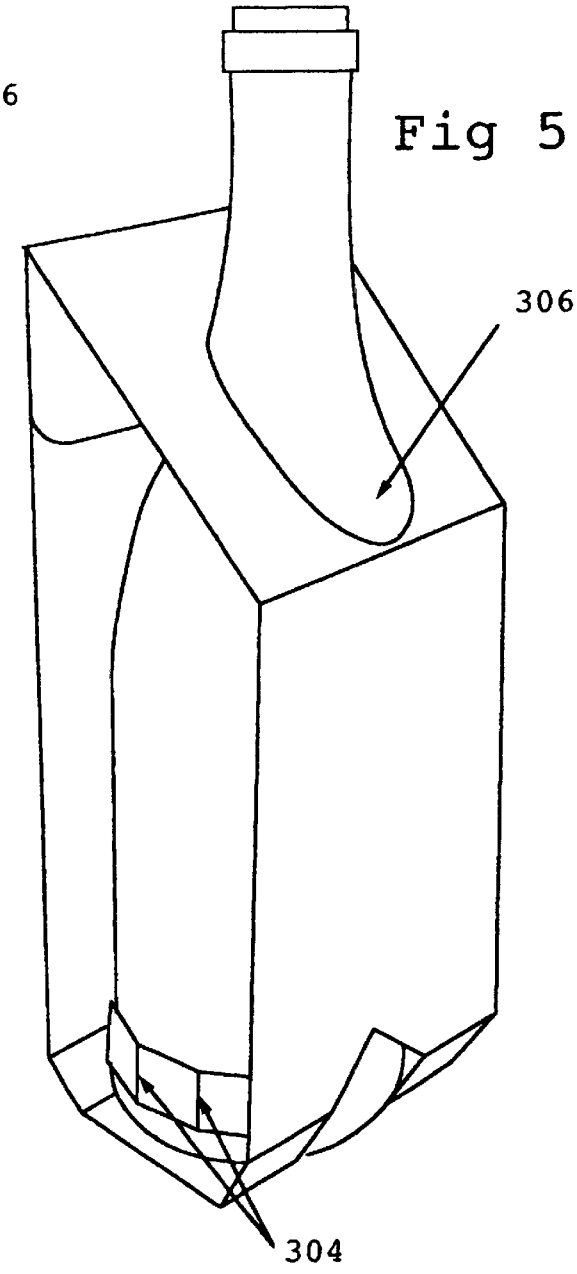
FIG. 51 is a perspective view showing the blank of FIG. 50 when fully erected with a single wine bottle.

Because card does not flex in the same way as a plastics material, the first strap 32 is provided with a series of extra creases 302 and the second strap 34 is provided with a series of extra creases 304. This allows the lower end of the bottle body to be firmly held, as indicated in FIG. 51, with the upper end of the bottle body extending through an oval aperture 306.

Figure 52:
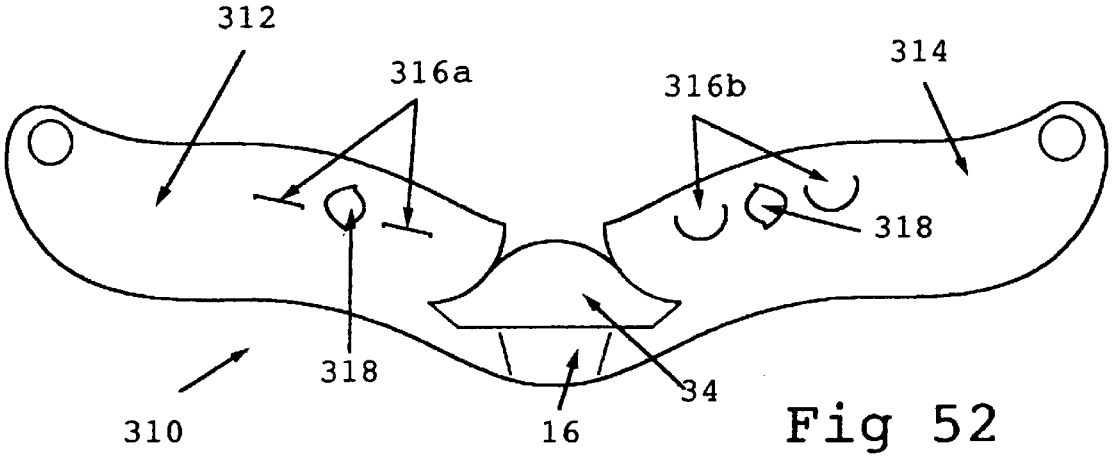
FIG. 52 is a plan view of a blank for a binder, primarily for use with a plant pot.
Figure 53:
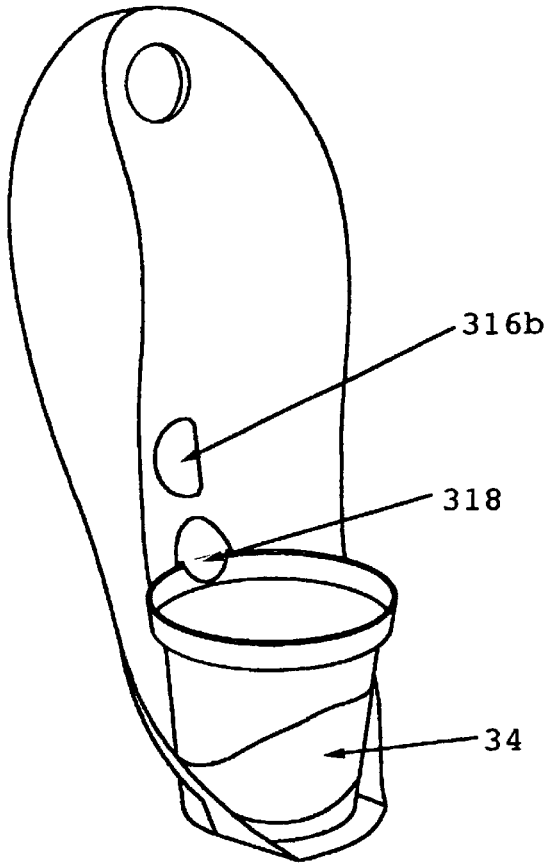
FIG. 53 is a perspective showing the blank of FIG. 52 when fully erected with a plant pot.

FIG. 52 shows a blank for a binder 310, according to the present invention, which is particularly suitable for use in carrying and displaying a plant pot. It will be seen that, in effect, the first strap 32 and part of the second panel 16 have been omitted, with the second strap 34 having been shaped to provide support for the front of the plant pot. Support for the rear of the plant pot is provided by the flaps 312, 314 which are held together in a partially overlapped condition by conventional pairs of securing slits 316*a* and securing tabs 316*b*. A further pair of tabs 318 are operable to clamp a rim at the upper end of the plant pot as shown in FIG. 53.

Figure 54:
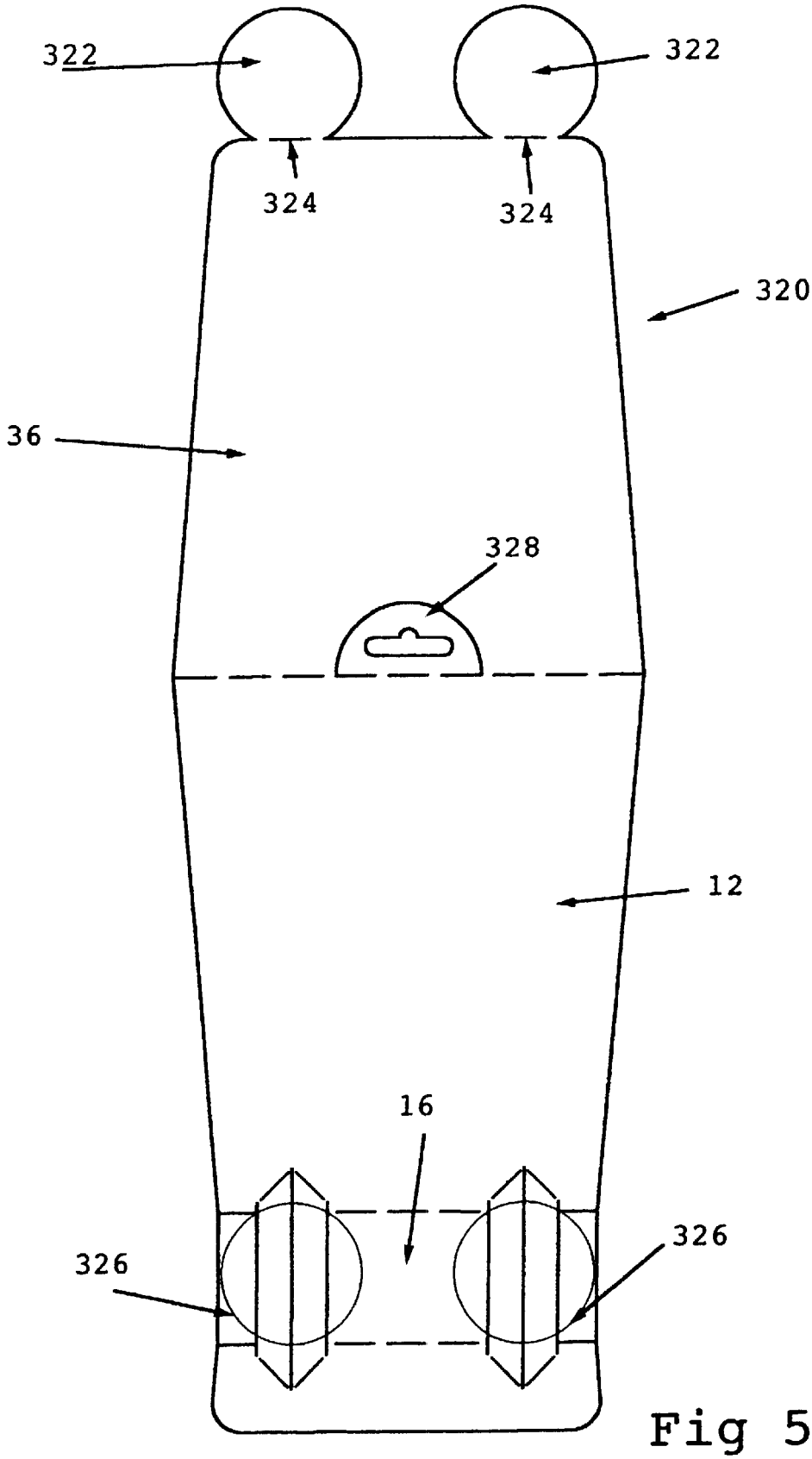
FIG. 54 is a plan view of a blank for a binder, primarily for use with tubes of suncream.

FIG. 54 shows a blank for a binder 320, according to the present invention, which is particularly suitable for use with tubes, such as tubes of suncream.

Figure 55:
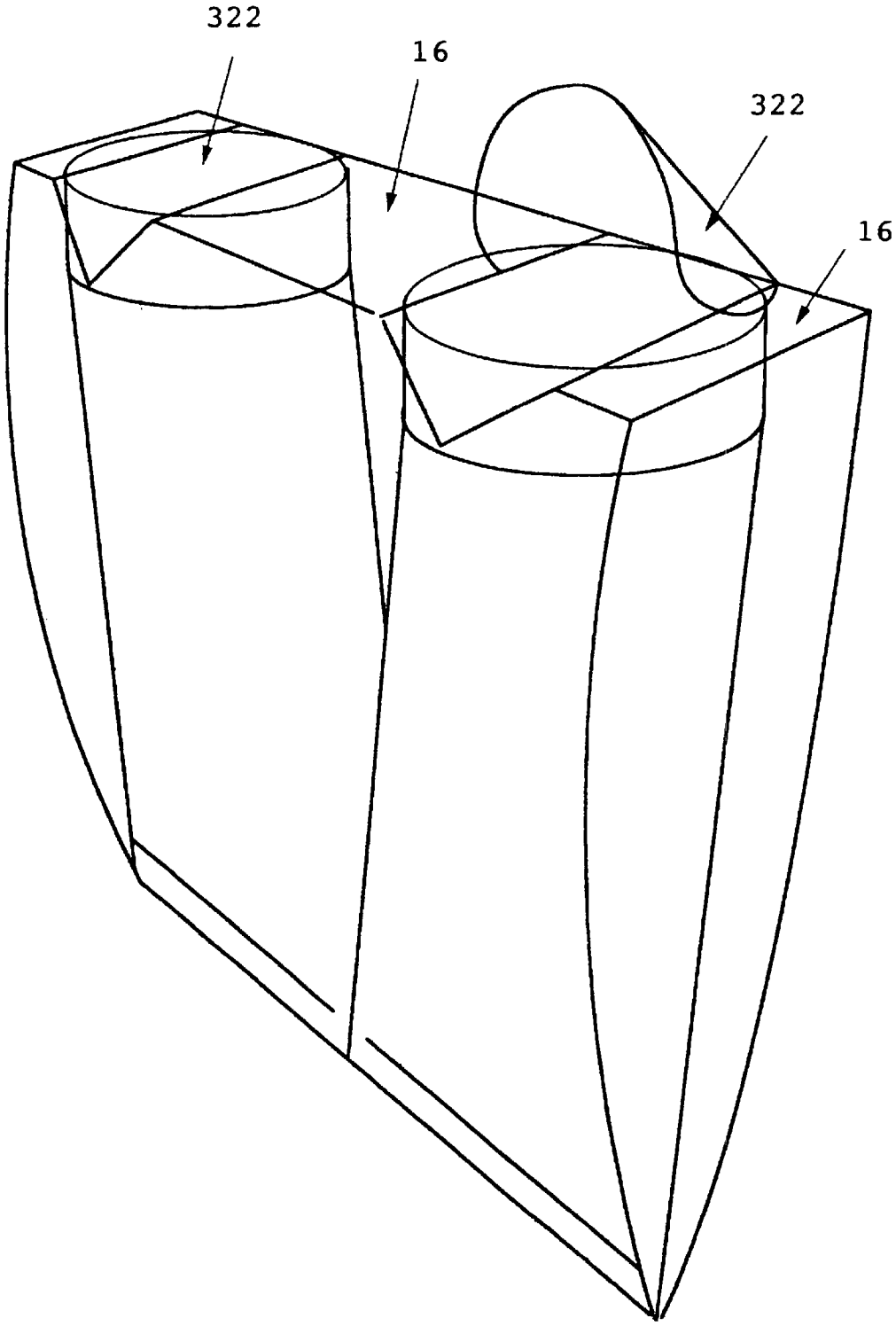
FIG. 55 is a perspective view showing the blank of FIG. 54 when partly erected with tubes of suncream.

The manner in which the cap or dispensing end of each of the tubes is held in place will be readily apparent. However, instead of any of the previously disclosed fastening arrangements, the flap 36 is provided with a pair of substantially circular tabs 322, each of which is hinged to the flap 36 about a fold line 324. When erected, as shown in FIG. 55, opposed parts of each of the tabs 322 are tucked beneath corresponding opposed parts of the second panel 16 to assume the positions shown by the faint lines 326 in FIG. 54. The tabs 322 can be of the same dimensions as the caps or dispensing ends of the tubes.

A further feature is that the fold line between the first panel 12 and the flap 36 can be provided with a conventional hanging cutout 328 (not shown in FIG. 55).

Figure 56:
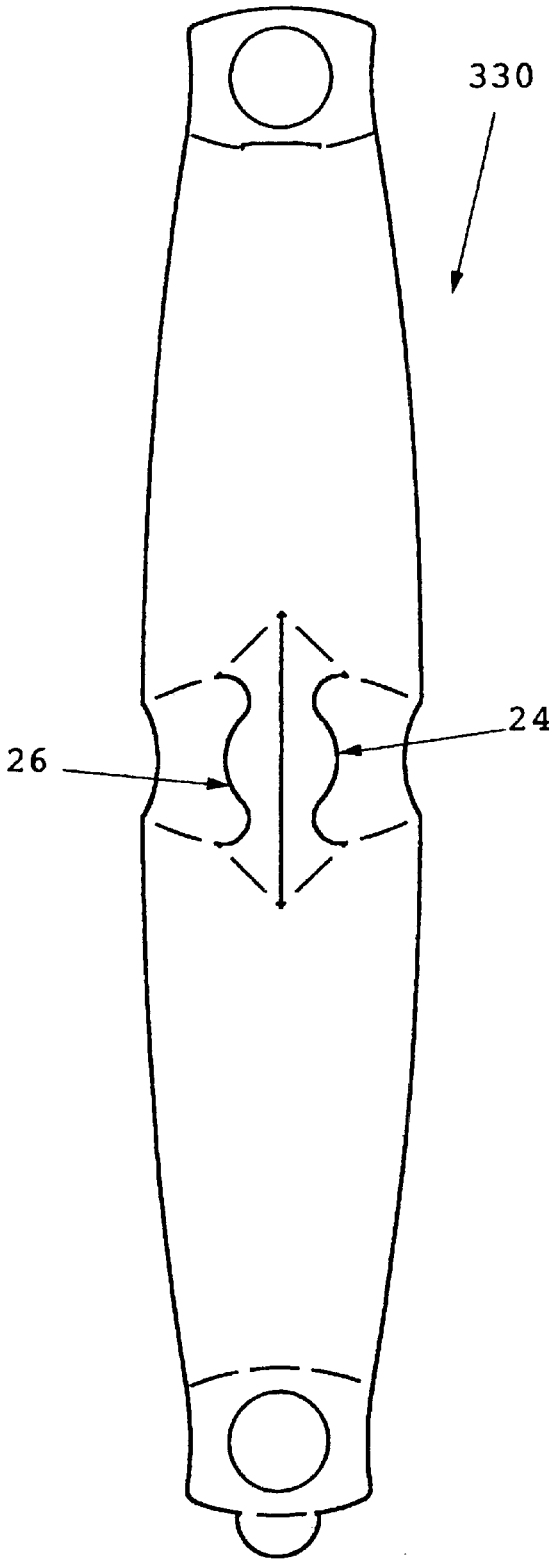
FIG. 56 is a plan view of a blank for a binder, primarily for use with a spherical object.
Figure 57:
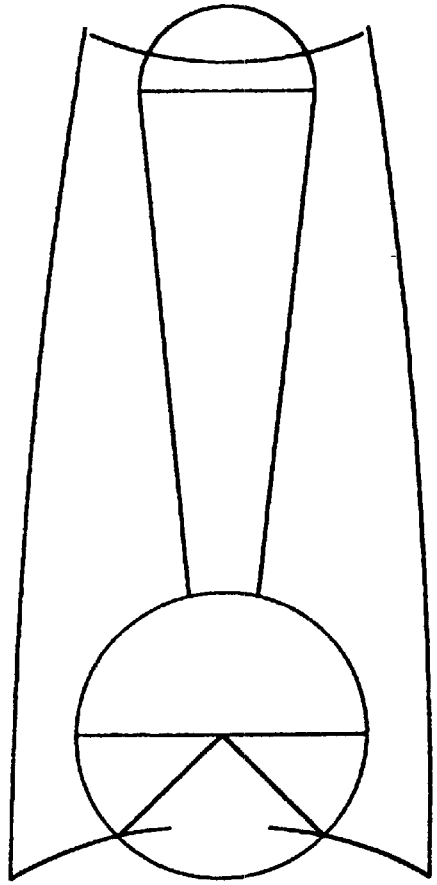
FIG. 57 is a side view showing the blank of FIG. 56 when fully erected with a spherical object.

FIG. 56 shows a blank for a binder 330, according to the present invention, which is particularly suitable for use with a spherical object, such as a ball.

Adequate support for the spherical object, such as the ball, is provided by the outer slits 24 and 26 having complex curved shapes.

Figure 58:
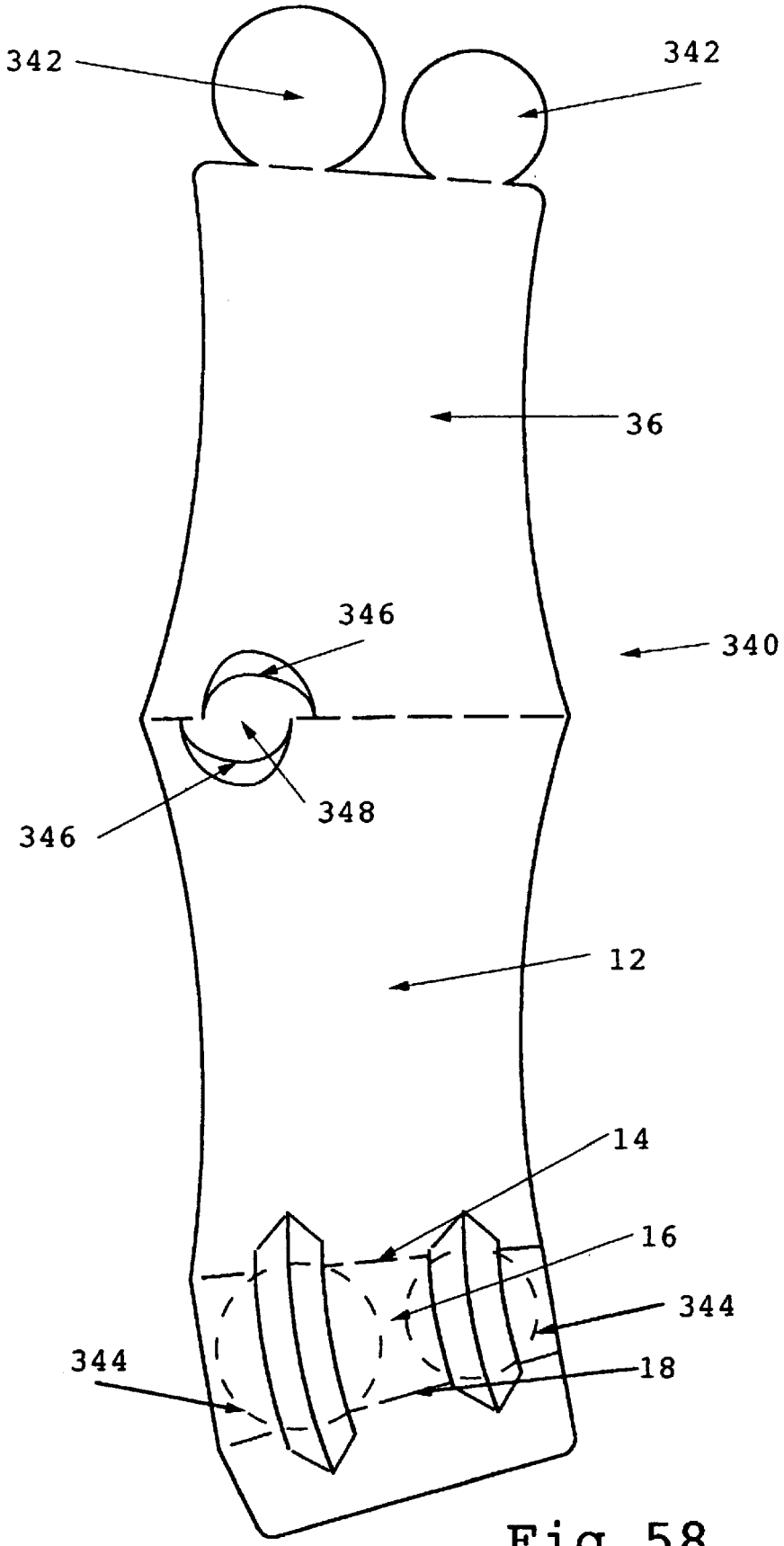
FIG. 58 is a plan view of a blank for a binder, primarily for use with objects of different sizes.

FIG. 58 shows a blank 340, according to the present invention, which is particularly suitable use with objects of different sizes, as a result of which the first fold line 14 and the second fold line 18 are arranged to diverge from one another.

The locking arrangement corresponds to that of FIGS. 54 and 55 in which a pair of substantially circular tabs 342, which are now of different diameter, tuck beneath adjacent opposed parts of the second panel 16 when fully erected, as indicated by the broken lines 344.

A pair of crescent shaped openings 346, offset from one another on opposed sides of the fold line between the first panel 12 and the flap 36, define a central region 348 for abutting an end of an object to be packaged, such as a bottle.

Figure 59:
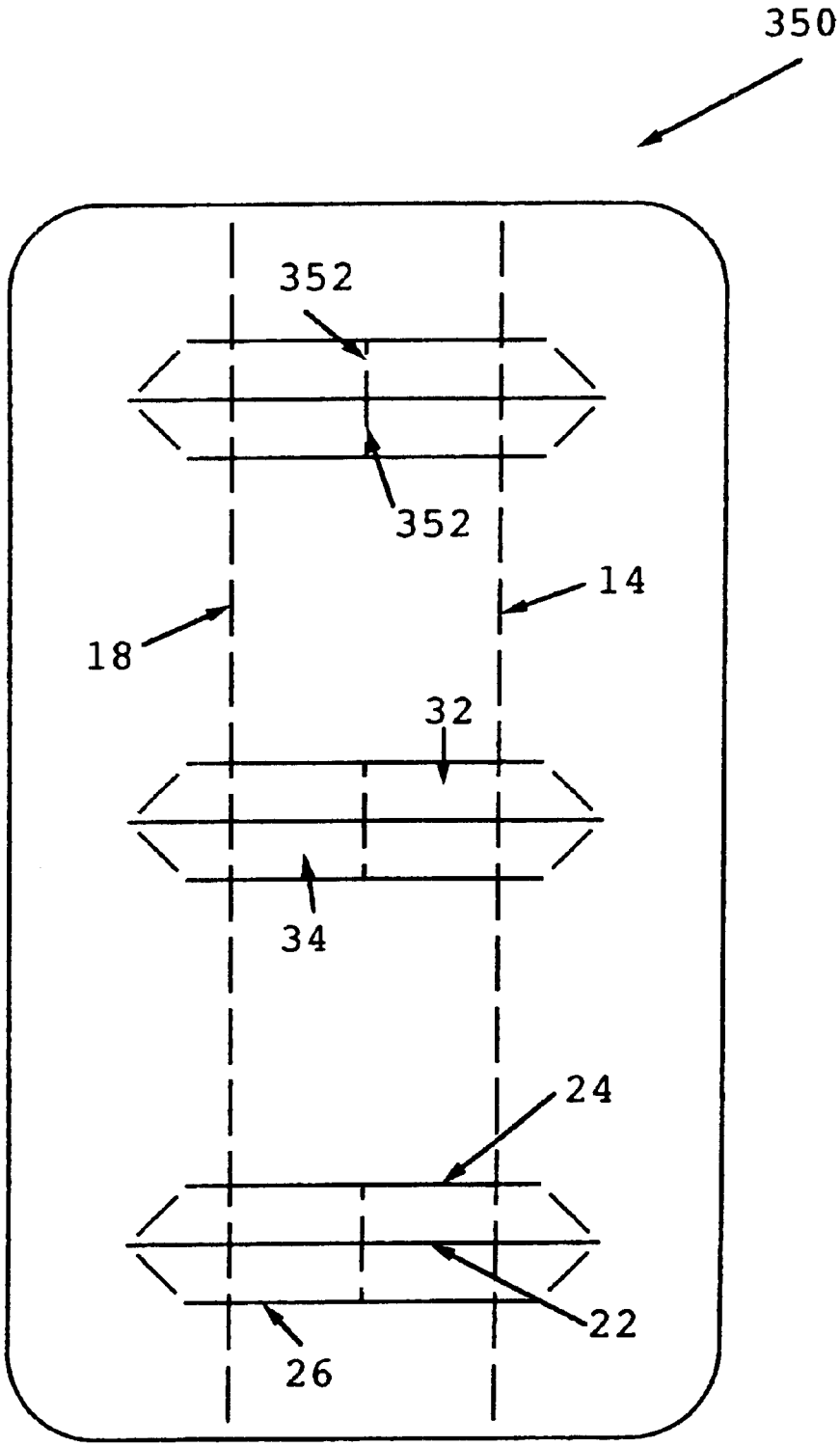
FIG. 59 is a plan view of a blank for a binder, primarily for use with disposable coffee cups.

FIG. 59 shows a blank 350, according to the present invention, which is particularly suitable for use with disposable coffee cups.

Figure 60:
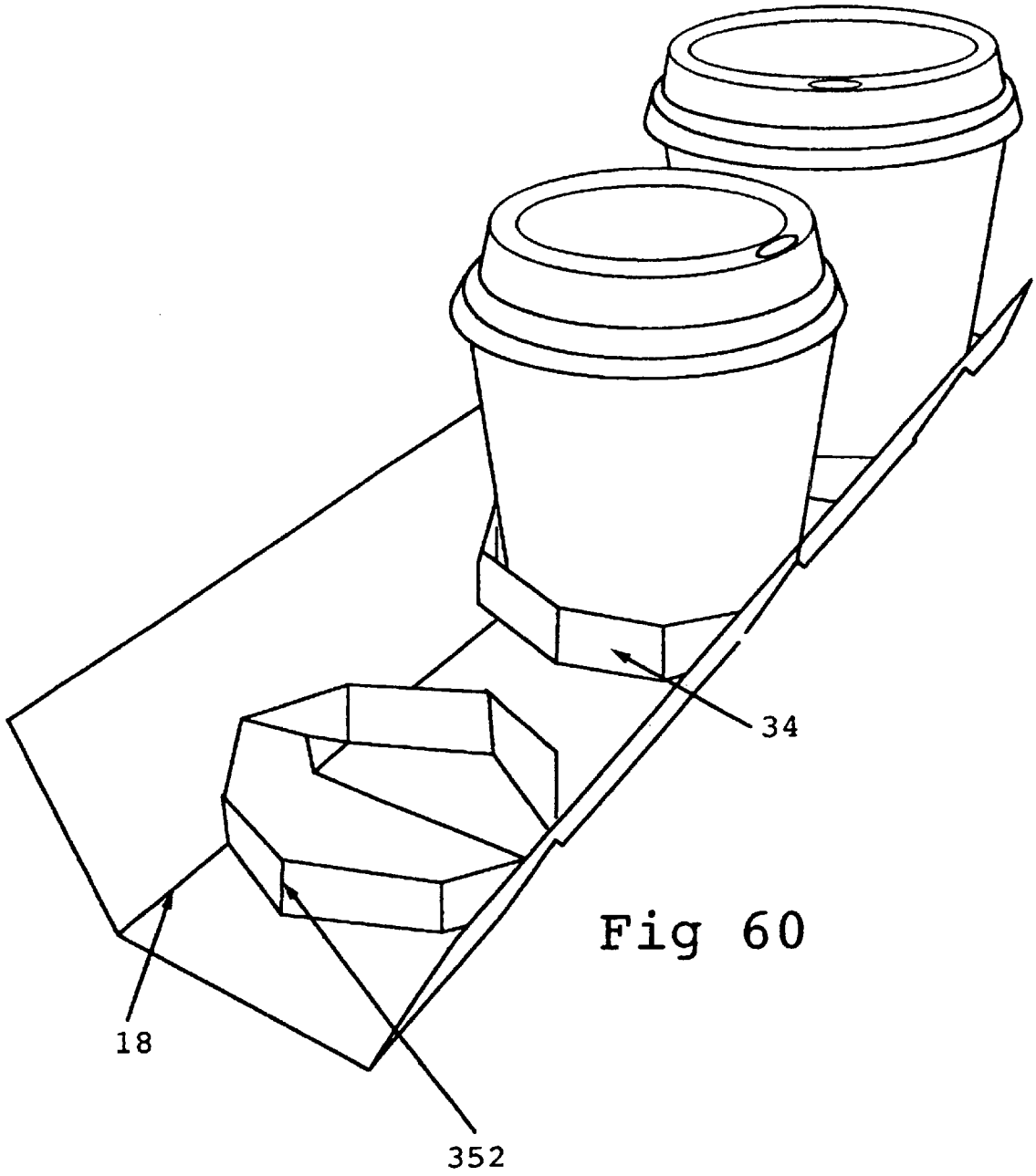
FIG. 60 is a perspective view showing the blank of FIG. 59 when fully erected around a pair of disposable coffee cups.
Figure 61:
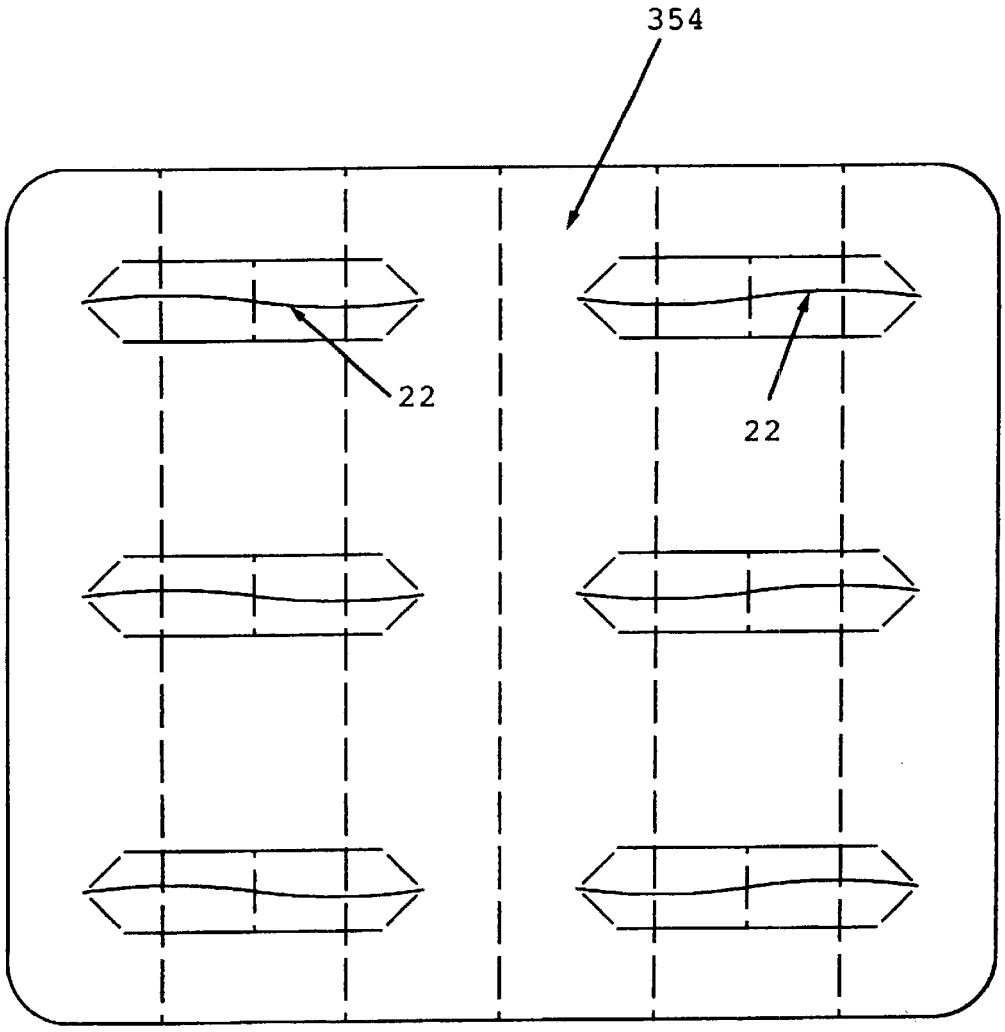
FIG. 61 is a plan view of a blank for a binder which effectively duplicates the blank of FIG. 59.

The blank 350 is preferably made of card rather than a plastics material. Each of the first straps 32 and each of the second straps 34 is thus formed with an extra crease 352 as discussed with reference to FIGS. 50 and 51. The fully erected condition with the disposable coffee cups is shown in FIG. 60. A similar blank 354 for use with six disposable coffee cups, and having non-linear central slits, 22 is shown in FIG. 61.

Figure 62:
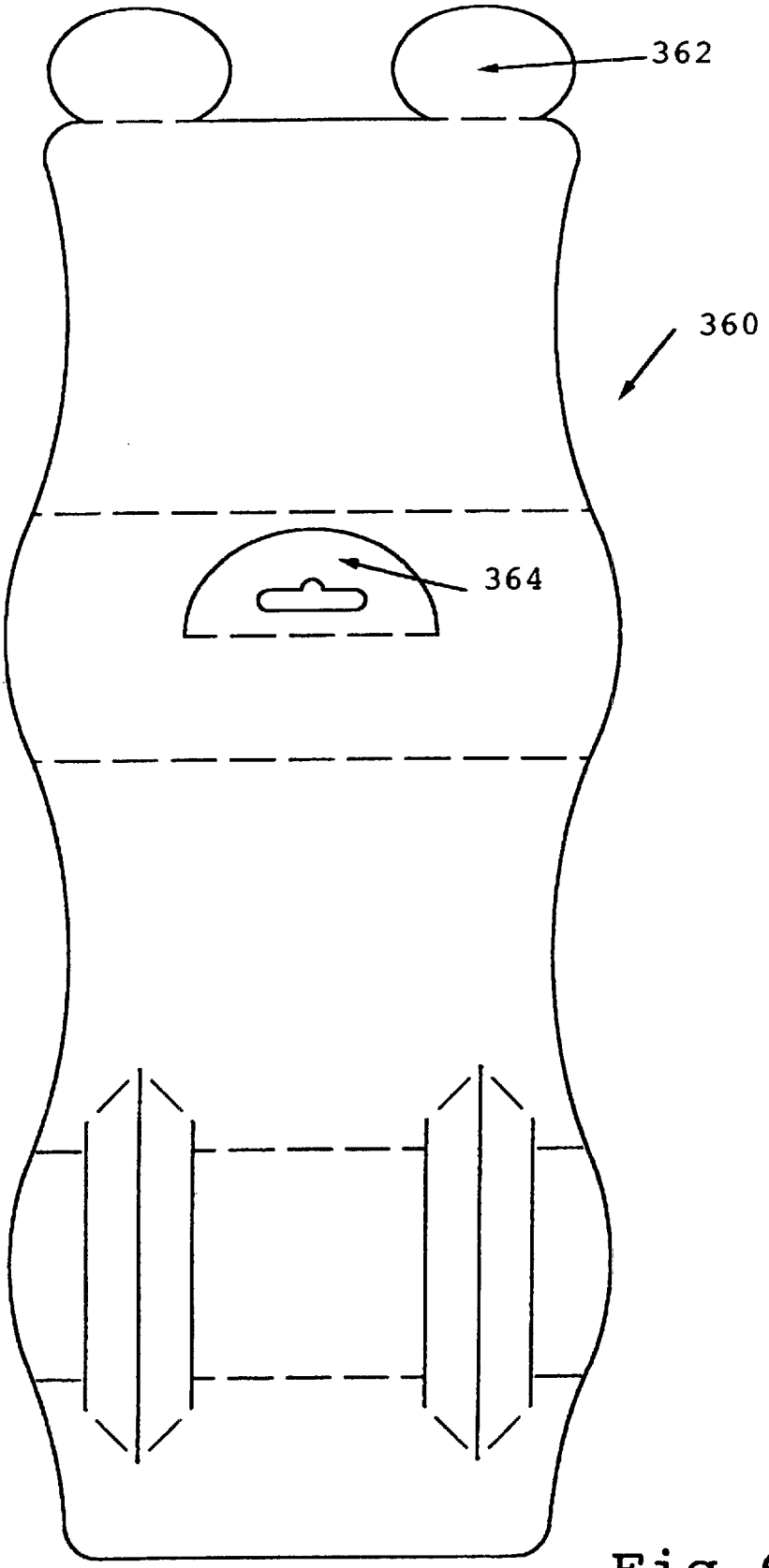
FIG. 62 is a plan view of a blank for a binder, primarily for use with coffee mugs.
Figure 63:
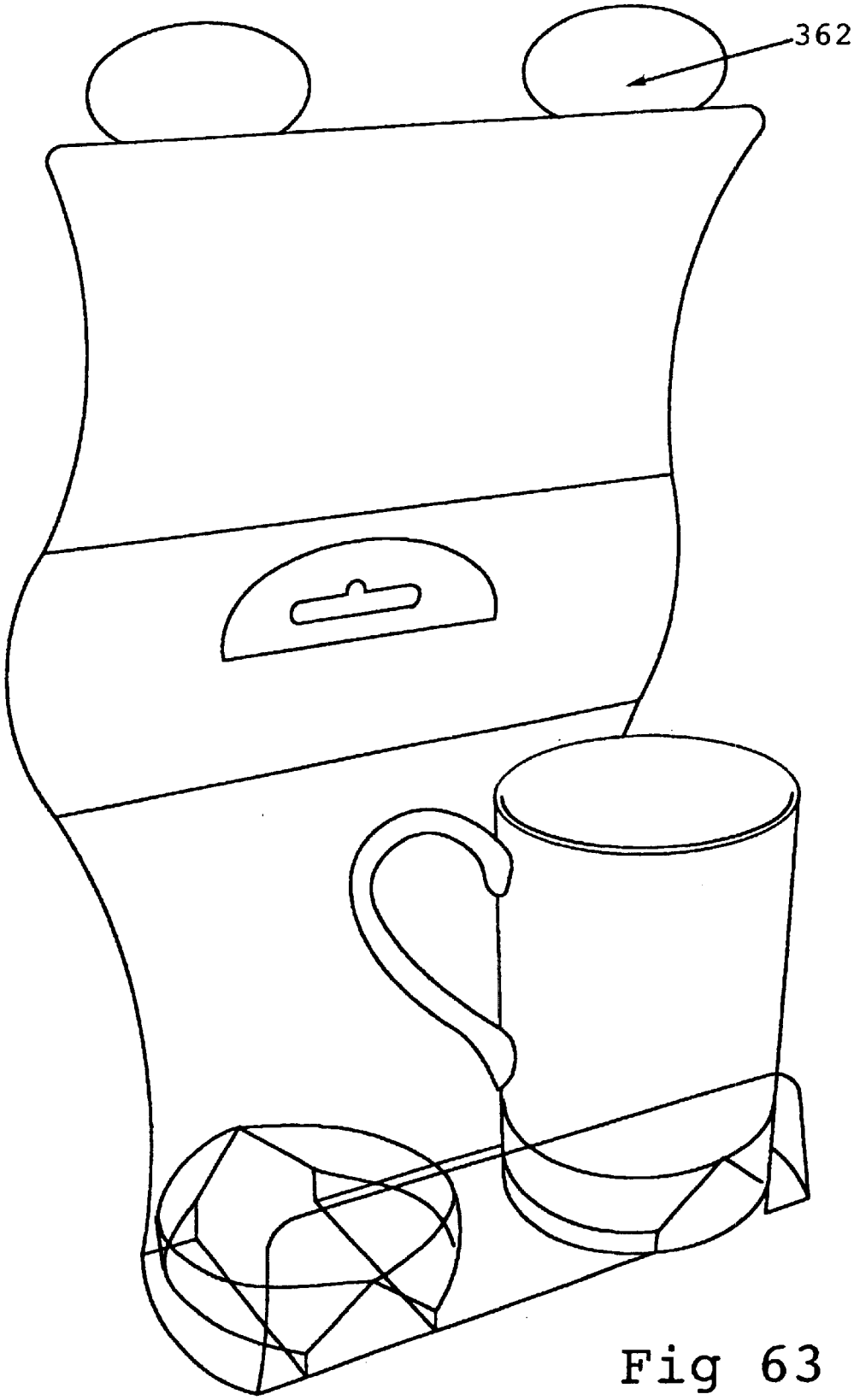
FIG. 63 is a perspective view showing the blank of FIG. 62 when partly erected.
Figure 64:
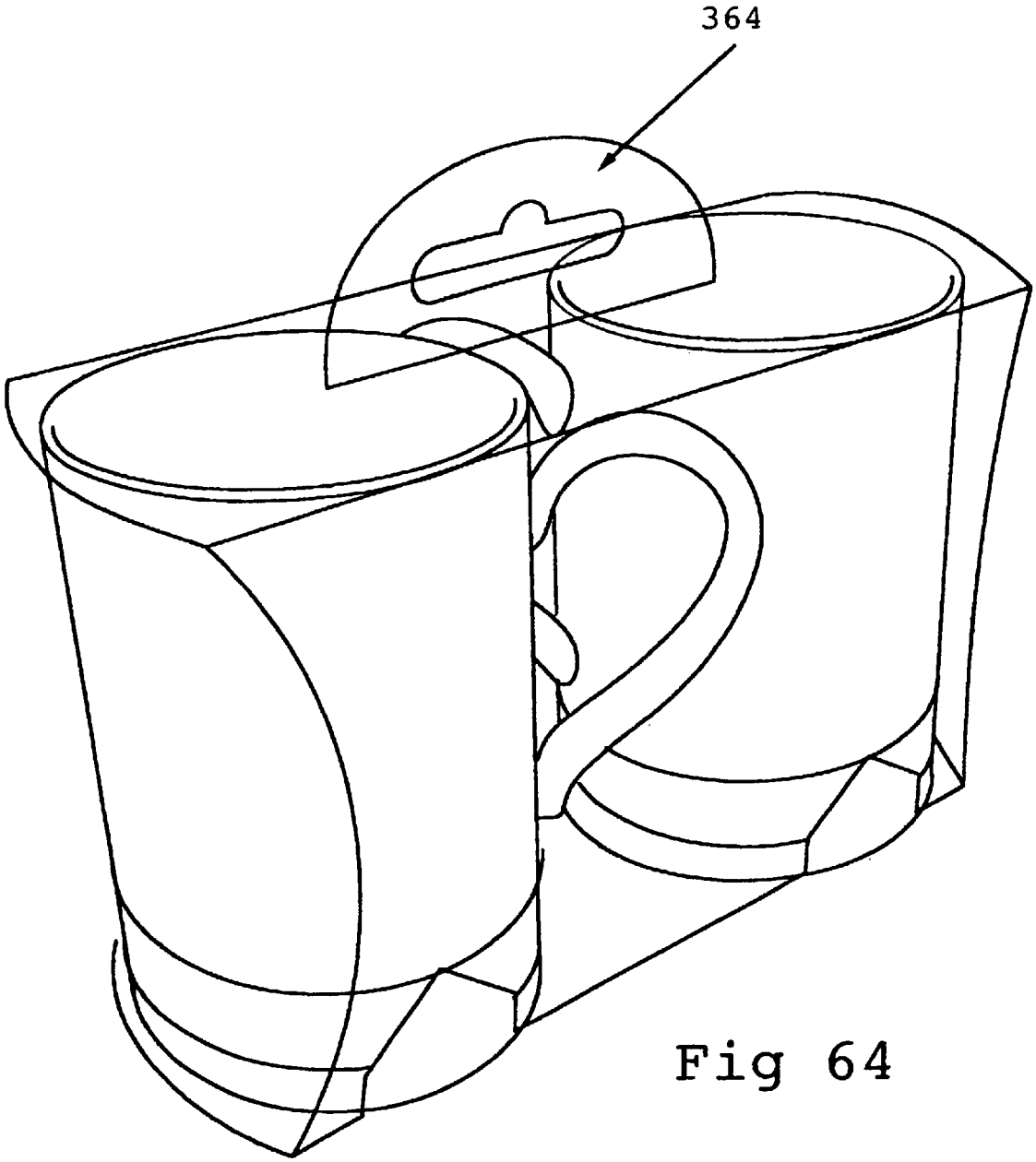
FIG. 64 is a perspective view showing the blank of FIG. 62 when fully erected with a pair of coffee mugs.

Finally, FIG. 62 shows a blank 360, according to the present invention, which is particularly suitable for use in the packaging of coffee mugs, or other articles with projections such as handles.

The blank 360 includes many features which are either identical to or closely derived from previously disclosed features. In particular, locking tabs 362 are here oval rather than substantially circular but operate in exactly the same manner as previously disclosed. Again, a conventional hanging cutout 364 is provided for ease of display.

What is claimed is:

1. A binder comprising:

a first panel divided by a first fold line from a second panel which is divided by a second fold line from a third panel, the first and second fold lines being intersected by three slits, the central slit being longer than the first and second outer slits and each end of the central slit being joined to an adjacent end of each of the first and second outer slits by a respective crease line; whereby, when the third panel is folded about outer parts of the first and second fold lines to be spaced from yet overlie the first panel, the material between the central slit and the first outer slit is folded about its associated crease lines and the inner parts of the first and second fold lines to form a first strap, and the material between the central slit and the second outer slit is folded about its associated crease lines and the inner parts of the first and second fold lines to form a second strap, wherein said first panel is formed with a fastening flap and an opening through which said first and third panels pass to form first and second carrying handles for said binder in a folded position, said first and second carrying handles having apertures therethrough to receive fingers of a user wherein said opening is non-linear and is shaped so that it has end margins located near opposing sides of the aperture of said first panel.

2. A binder according to claim 1, in which the first and second fold lines are parallel or substantially parallel to one another.

3. A binder comprising:

a first panel divided by a first fold line from a second panel which is divided by a second fold line from a third panel, the first and second fold lines being intersected by three slits, the central slit being longer than the first and second outer slits and each end of the central slit being joined to an adjacent end of each of the first and second outer slits by a respective crease line; whereby, when the third panel is folded about outer parts of the first and second fold lines to be spaced from yet overlie the first panel, the material between the central slit and the first outer slit is folded about its associated crease lines and the inner parts of the first and second fold lines to form a first strap, and the material between the central slit and the second outer slit is folded about its associated crease lines and the inner parts of the first and second fold lines to form a second strap, wherein said first and second fold lines are divergent.

4. A binder according to claim 1, in which the material of the binder is a sheet-like material.

5. A binder according to claim 4, in which the sheet-like material is a plastics material.

6. A binder according to claim 4, in which the sheet-like material is card or cardboard.

7. A binder according to claim 1, in which the first panel is extended to form the fasting flap to be folded over and secured to the third panel.

8. A binder according to claim 1, in which the first and second straps have extra creases to facilitate folding.

9. A binder according to claim 1, in which a series of the first and/or second fold lines is provided to allow the distance between the first and the third panels to be adjusted.

10. A binder according to claim 9, in which all of the central and outer slits are capable of being lengthened.

11. A binder according to claim 1, in which all of the central and outer slits are parallel or substantially parallel.

12. A binder according to claim 1, in which parts of the binder which are to be secured to one another are secured by tab/slit connections.

13. A binder according to claim 1, in which locking tabs are provided which, when the binder is erected, have opposed parts which are tucked inside corresponding opposed parts of the second panel.

* * * * *